US008582275B2

(12) United States Patent
Yan et al.

(10) Patent No.: US 8,582,275 B2
(45) Date of Patent: Nov. 12, 2013

(54) ELECTRONIC DETONATOR CONTROL CHIP

(75) Inventors: Jinglong Yan, Beijing (CN); Xing Liu, Beijing (CN); Fengguo Li, Beijing (CN); Huaping Lai, Beijing (CN); Xianyu Zhang, Beijing (CN)

(73) Assignee: Beijing Ebtech Technology Co., Ltd., Beijing (CN)

( * ) Notice: Subject to any disclaimer, the term of this patent is extended or adjusted under 35 U.S.C. 154(b) by 303 days.

(21) Appl. No.: 12/913,669

(22) Filed: Oct. 27, 2010

(65) Prior Publication Data

US 2011/0056399 A1 Mar. 10, 2011

Related U.S. Application Data

(63) Continuation of application No. PCT/CN2009/071504, filed on Apr. 27, 2009.

(30) Foreign Application Priority Data

| | | |
|---|---|---|
| Apr. 28, 2008 | (CN) | 2008 2 0111269 |
| Jun. 4, 2008 | (CN) | 2008 2 0115927 |
| Sep. 24, 2008 | (CN) | 2008 1 0211374 |
| Sep. 24, 2008 | (CN) | 2008 2 0136278 |
| Nov. 7, 2008 | (CN) | 2008 1 0172410 |

(51) Int. Cl.
*F23Q 7/00* (2006.01)

(52) U.S. Cl.
USPC ..... 361/248; 361/249; 361/250; 361/251; 102/202; 102/206; 102/215

(58) Field of Classification Search
USPC ..... 102/202, 206, 215; 361/248, 249, 250, 361/251
See application file for complete search history.

(56) References Cited

U.S. PATENT DOCUMENTS

| | | | | |
|---|---|---|---|---|
| 4,296,688 | A | 10/1981 | Orlandi | |
| 5,440,990 | A * | 8/1995 | Wiedefeld et al. | 102/215 |
| 6,085,659 | A * | 7/2000 | Beukes et al. | 102/206 |
| 6,222,749 | B1 * | 4/2001 | Peron | 363/125 |
| 6,714,876 | B2 * | 3/2004 | Kimoto et al. | 702/24 |
| 2003/0000411 | A1 | 1/2003 | Cernocky et al. | |

FOREIGN PATENT DOCUMENTS

FR 2672675 A1 8/1992

* cited by examiner

*Primary Examiner* — Rexford Barnie
*Assistant Examiner* — Tien Mai
(74) *Attorney, Agent, or Firm* — Hultquist, PLLC; Steven J. Hultquist; Mary B. Grant

(57) ABSTRACT

An electronic detonator control chip (100) includes a communication interface circuit (101), a rectification bridge circuit (102), a charging circuit (103), a charging control circuit (110), a power management circuit (104), a firing control circuit (105), a logic control circuit (106), a non-volatile memory (107), a reset circuit (111), a safe discharging circuit (108), and a clock circuit (202). Wherein, the communication interface circuit (101) includes a data modulation module (210) and a data demodulation module (211) including two data demodulation circuits (212). The logic control circuit (106) further includes a programmable delay module (281), an input/out interface (282), a serial communication interface (283), a prescaler (284), a CPU (285), and so on. Therefore, the electronic detonator control chip provided by the invention enables to realize the functions of two-wire non-polarity connection, bidirectional communication with a detonation equipment external of the electronic detonator control chip, ID card inside the detonator, control of the detonation process and online program of the delay time and so on.

31 Claims, 19 Drawing Sheets

ELECTRONIC DETONATOR CONTROL CHIP

CROSS-REFERENCE TO RELATED APPLICATIONS

This application is a continuation of International Patent Application No. PCT/CN09/71504 filed Apr. 27, 2009 and designating the United States, which application in turn claims priority of Chinese Patent Application No. 200820111269.7 filed Apr. 28, 2008, Chinese Patent Application No. 200820115927.X filed Jun. 4, 2008, Chinese Patent Application No. 200820136278.1 filed Sep. 24, 2008, Chinese Patent Application No. 200810211374.2 filed Sep. 24, 2008, and Chinese Patent Application No. 200810172410.9 filed Nov. 7, 2008. The disclosures of each of the foregoing applications are hereby incorporated herein by reference in their respective entireties, for all purposes.

TECHNICAL FIELD

The present invention relates to the field of the manufacturing technology of initiating explosive device, in particular to an electronic detonator control chip.

BACKGROUND OF THE INVENTION

A delay element is used to realize the function of delay of traditional electric detonators, which results in not only low precision but also unchangeable delay time. In addition, since the delay element contains delay composition and heavy metal such as lead, the use of traditional electric detonators can lead to dispersion of the heavy metal and the burning of the delay composition, both causing environment pollution.

Further, public safety problems may arise from the traditional electric detonator. On the one hand, the process of detonation of a traditional electric detonator is uncontrollable because the detonation process starts immediately once the detonator is powered, and the process is irreversible and can not be interrupted or stopped in case of emergency. On the other hand, since the ignition unit is connected directly to detonator wires, external interferences such as static electricity, radio frequency, stray current and so on may directly affect the security of the detonator during production, storage and use.

Under traditional management system and technology, the traditional detonators can not be easily managed and controlled and sometimes be accessible to unauthorized persons. Lost detonators can definitely do harm to social security. Therefore, the management in China is made by coding and tagging the detonators on the shell. However, the physical process of tagging on the shell may reduce the safety of detonator production, and further, coding and tagging still cannot solve the controllability problem in detonator management.

To overcome defects mentioned above in traditional electric detonators, study of electronic detonators based on circuit technology and micro-electronics technology has been done since 1980's in Japan, Australia, Europe and some other developed countries or districts. The key design of the electronic detonator lies in an electronic detonator controller circuit board, which is connected between the detonator wires and the ignition unit to separate them and makes the detonation process controllable.

Great progress in the electronic detonator technology has been made with rapid development of electronic technology, micro-electronics technology, and information technology.

Application experiment and market promotion of the electronic detonator have been conducted out since the late 1990s.

SUMMARY OF THE INVENTION

The electronic detonator control chip is the core component on the electronic detonator controller circuit board that controls the detonation process. Therefore, the purpose of the present invention is to solve various defects of the traditional electric detonators and to provide an electronic detonator control chip that can realize the functions of two-wire non-polarity connection, bidirectional communication with an external detonation apparatus, identity code built-in, controllability of the detonation process, and online program of the delay time.

This invention relates to an electronic detonator control chip which includes a communication interface circuit, a rectifier bridge circuit, a charging circuit, a charging control circuit, a power supply management circuit, a firing control circuit, a logic control circuit, a non-volatile memory, a reset circuit, a safe discharging circuit, and a clock circuit.

In the electronic detonator control chip, one end of the rectifier bridge circuit is connected to the communication interface circuit, forming at least one first pin extending to the exterior of the chip; one end of the rectifier bridge circuit leads to the charging circuit and the charging control circuit, supplying power to the both above; the other end of the rectifier bridge circuit is grounded. The rectifier bridge circuit realizes non-polarity connection of the electronic detonator wires and eliminates the risk of the damage to the electronic detonator control chip caused by reverse connection of the electronic detonator wires, which makes the use of the electronic detonator easier and more secure.

In the electronic detonator control chip, one end of the charging circuit is connected to the rectifier bridge circuit; the other end is connected to the power supply management circuit and also extends to the exterior of the chip, forming at least one second pin. This circuit realizes power storage of the storage unit at the external of the electronic detonator control chip, thus, the energy in the storage unit can still ensure the electronic detonator control chip to work normally in a certain period of time in case the power supply from the external of the electronic detonator is interrupted due to flying rocks and other accidents in a blasting engineering.

In the electronic detonator control chip, one end of the charging control circuit is connected to the rectifier bridge circuit, one end is grounded, and one end is connected to the logic control circuit; another end of the charging control circuit is connected to the safe discharging circuit and also extends to the exterior of the chip, forming at least one third pin. This circuit realizes the control of the charging process of the ignition capacitor at the external of the electronic detonator control chip. Because of the strict control of this process, the operation security of the electronic detonator can be ensured during the preparation for detonation.

In the electronic detonator control chip, one end of the safe discharging circuit is connected to the logic control circuit, one end is grounded, and the other end is connected to the third pin within the chip. This circuit allows an interruptible detonation process of the electronic detonator, thus enhancing the ability of the electronic detonator blasting network in disposing faults.

In the electronic detonator control chip, one end of the power supply management circuit is connected to the second pin within the chip, and one end is grounded; the other end of the power supply management circuit, as the power supply output terminal of the chip, extends to the exterior of the chip, forming at least one fourth pin.

In the electronic detonator control chip, one end of the communication interface circuit is grounded, one end is connected to the first pin within the chip, one end leads to the logic control circuit, and the other end is connected to the fourth pin within the chip. The existence of the communication interface circuit realizes information exchange between the electronic detonator and the external detonation apparatus, and making the electronic detonator programmable online; it also allows the control of detonation process by the external detonation apparatus, which makes the detonation process more secure.

In the electronic detonator control chip, one end of the reset circuit is grounded, one end is connected to the fourth pin within the chip, and the other end is connected to the logic control circuit.

In the electronic detonator control chip, one end of the firing control circuit is grounded, one end extends to the exterior of the chip, forming at least one fifth pin, and the other end leads to the logic control circuit. The firing control circuit interrupts the connection between the ignition unit and the external detonator wires, so that it can protect the ignition unit from the influence of static electricity, radio frequency, stray current and other interferences, making the storage and use of the electronic detonator more secure. The firing control circuit is controlled by the logic control circuit, so even if the external storage unit used for charging the ignition unit and the chip is completely charged to ignite the detonator, the detonator can initiate only under the control of the external detonation apparatus, thus realizing the detonation energy management and making the detonation process more secure.

In the electronic detonator control chip, one end of the clock circuit is connected to the fourth pin within the chip, and the other end leads to the logic control circuit. The clock circuit makes the delay time of the detonator more accurate.

In the electronic detonator control chip, one end of the logic control circuit is connected to the clock circuit, one end is connected to the fourth pin within the chip, one end is grounded, one end is connected to the non-volatile memory, one end is connected to the communication interface circuit, one end is connected to the reset circuit, one end is connected to the safe discharging circuit, one end is connected to the charging control circuit, and the other end is connected to the firing control circuit. The logic control circuit and the clock circuit work together to realize the function of time delay of the detonator. This avoids the use of delay composition, reducing the use of heavy metal and environmental pollution.

In the electronic detonator control chip, one end of the non-volatile memory is connected to the fourth pin within the chip, one end is connected to the logic control circuit, and the other end is grounded. The non-volatile memory stores the electronic coding and identity serial number of the electronic detonator, realizing the identity/password management of the electronic detonators, avoiding coding and tagging in the process of manufacturing, and improving production security of the detonators.

In one embodiment of the invention, the charging circuit includes a first resistor and a first diode in series. The cathode of the first diode is connected to the power supply management circuit, and extends to the exterior of the chip, forming the second pin. Resistance of the first resistor is preferred between 1 and 10 KΩ. In this technical solution, the first resistor connected in the charging circuit in series is used to limit the charging current to avoid the impact of charging current of the signal bus that all the detonators connect to and to improve reliability of the system. If resistance of the first resistor is limited to 1~10KΩ, the charging current can be controlled in milliampere dimension, and thus avoiding damage to the chip caused by the excessive current. The first diode connected in the charging circuit in series can limit the reverse current; without the first diode, energy stored in the capacitor of the storage unit will release reversely via the charging circuit when the external power supply is interrupted, resulting in the energy consumption of the storage unit.

In another embodiment of the invention, the safe discharging circuit includes a second resistor and a first NMOS transistor. Wherein, the source and the substrate of the first NMOS transistor are grounded, its drain is connected to the third pin via the second resistor, and its grid is connected to the logic control circuit. Resistance of the second resistor is preferred between 1 and 10 KΩ. This technical solution enhances the security of the ignition capacitor in the storage unit, that is, the ignition capacitor is ensured to be shorted in the processes of communication and exchanges of data, so that the ignition capacitor does not store any power, thus ensuring operation security of the electronic detonator before detonation. In addition, during the preparation for detonation, and after the capacitor in the external storage unit has been charged and gets ready completely, if the detonation is about to be canceled because of some kind of failure, the capacitor can be discharged via the safe discharging circuit, which improves the ability of the electronic detonator in disposing faults.

In another embodiment of the invention, the firing control circuit includes a second NMOS transistor. The source and the substrate of the second NMOS transistor are grounded, its drain is connected to the fifth pin, and its grid is connected to the logic control circuit. In this technical solution, the direct connection between the ignition unit and the detonator wires at the external of the chip has been insulated to avoid the effect of static electricity, radio frequency, stray current and other interferences on the system security. In addition, it realizes controllability of the ignition process.

In another embodiment of the invention, the charging control circuit includes a third resistor, a fourth resistor, a second diode, a first PMOS transistor, and a third NMOS transistor. Wherein, the source and the substrate of the third NMOS transistor are grounded, its grid is connected to the logic control circuit, and its drain is connected to the grid of the first PMOS transistor. The source and the substrate of the first PMOS transistor are connected to the rectifier bridge circuit, while its drain is connected to the third pin via the third resistor and the second diode in series with the cathode of the second diode towards the third pin; and the fourth resistor crosses over the substrate of the first PMOS transistor and the drain of the third NMOS transistor. Resistance of the third resistor and the fourth resistor is preferred between 1 and 10 KΩ, and the purpose of which is to control the current in milliampere dimension to avoid the excessive current that will affect system reliability.

As another specific embodiment of the charging control circuit, the charging control circuit includes a fifth resistor, a sixth resistor, a third diode, a second PMOS transistor, and a fourth NMOS transistor. Wherein, the source and the substrate of the fourth NMOS transistor are grounded, its grid is connected to the logic control circuit, and its drain is connected to the grid of the second PMOS transistor. The source and the substrate of the second PMOS transistor are connected to the rectifier bridge circuit via the fifth resistor; its drain is connected to the third pin via the third diode, with the cathode of the third diode towards the third pin; the sixth resistor crosses over the substrate of the second PMOS transistor and the drain of the fourth NMOS transistor. Resistance of the fifth resistor and the sixth resistor is preferred between 1 and 10 KΩ, the purpose of which is to control the current in milliampere dimension to avoid the excessive current that will affect reliability of the system.

In another embodiment of the invention, the rectifier bridge circuit includes a third PMOS transistor, a fourth PMOS transistor, a fifth NMOS transistor, and a sixth NMOS transistor. Wherein, the drain and the substrate of the third PMOS transistor, and the drain and the substrate of the fourth PMOS transistor connect together, and are connected to the charging circuit and the charging control circuit simultaneously. The source and the substrate of the fifth NMOS transistor, and the source and the substrate of the sixth NMOS transistor connect together, and are grounded simultaneously. The source of the third PMOS transistor, the grid of the fourth PMOS transistor, the drain of the fifth NMOS transistor, and the grid of the sixth NMOS transistor connect together, and extend to the exterior of the chip, forming one of the set of the first pin; the source of the fourth PMOS transistor, the grid of the third PMOS transistor, the drain of the sixth NMOS transistor, and the grid of the fifth NMOS transistor connect together, and extend to the exterior of the chip, forming the other of the set of the first pin.

The advantages of the technology solution above lie in: on the one hand, voltage drop of a MOS transistor depends on the threshold voltage of the MOS transistor, therefore, selecting a MOS transistor with lower threshold voltage can reduce the differential voltage of the input terminal and the output terminal of the rectifier bridge circuit, thereby increasing the efficient utilization rate of the energy input to the rectifier bridge circuit. On the other hand, when a MOS transistor is integrated, serial use is allowed, which will reduce the dependence of chip design on the integration process.

As another specific embodiment of the rectifier bridge circuit, the rectifier bridge circuit further includes a fourth diode and a fifth diode. Wherein, the anode of the fourth diode and the anode of the fifth diode are connected to the first pin respectively; the cathode of the fourth diode and the cathode of the fifth diode connect together, with both connected to the drain and the substrate of the third PMOS transistor, as well as the drain and the substrate of the fourth PMOS transistor. The advantages of this embodiment lie in: on the one hand, the anode of the two diodes is connected to the source of the two PMOS transistors respectively, while the cathode of the two diodes is connected to the drain and the substrate of the two PMOS transistors simultaneously, adopting the diode connected forward to speed up the establishment process; on the other hand, the maximum voltage drop between the source and the substrate of the PMOS transistors is limited to the voltage drop of the diode, so at the forepart of the PMOS channel's establishment and when the voltage of the substrate of the PMOS transistor is still low, this embodiment can reduce the current going through forward PN junction between the source and the substrate of the PMOS transistor, protecting the PMOS transistors from breakdown.

In another embodiment of the invention, the charging control circuit has another end, which is connected to the fourth pin within the chip, that is, it is connected to the power supply management circuit, and the charging control circuit is powered by the power supply management circuit.

As first specific embodiment of the charging control circuit in the above embodiment according to the invention, the charging control circuit includes a fifth PMOS transistor, a sixth PMOS transistor, a seventh PMOS transistor, a seventh NMOS transistor, an eighth NMOS transistor, a ninth NMOS transistor, a seventh resistor, and a sixth diode. The detailed connection is described as follows:

The source and the substrate of the fifth PMOS transistor are connected to the power supply management circuit; the grid of the fifth PMOS transistor, the grid of the seventh NMOS transistor, and the grid of the eighth NMOS transistor are all connected to the logic control circuit; the drain of the fifth PMOS transistor, the drain of the seventh NMOS transistor, and the grid of the ninth NMOS transistor connect together. The source and the substrate of the sixth PMOS transistor, and the source and the substrate of the seventh PMOS transistor connect together, with all connected to the rectifier bridge circuit together; the grid of the sixth PMOS transistor, the drain of the seventh PMOS transistor, and the drain of the ninth NMOS transistor are connected to one end of the seventh resistor, the other end of the seventh resistor is connected to the anode of the sixth diode, and the cathode of the sixth diode is connected to the third pin within the chip; the drain of the sixth PMOS transistor, the grid of the seventh PMOS transistor, and the drain of the eighth NMOS transistor connect together. The source and the substrate of the seventh NMOS transistor, the source and the substrate of the eighth NMOS transistor, and the source and the substrate of the ninth NMOS transistor are grounded together.

The advantages of the first embodiment lie in: with CMOS technology, control of the high-voltage charging power supply output by the power supply management circuit, which is under the low-voltage signal output by the logic control circuit is realized. This embodiment ensures that there is one MOS transistor between the two MOS transistors of each branch in the state of cut-off at any time, which avoids leakage current of each branch of the charging control circuit and reduces operating current of the charging control circuit. In addition, the ninth NMOS transistor is connected to the drain of the seventh PMOS transistor which acts as a charging control switch in this embodiment, thus avoiding the anode of the diode which limits reverse current in a potential floating state, in case the seventh PMOS transistor stops operating, which has the similar effect as the addition of a safe control switch to the charging loop including the storage unit, that further enhancing the security of the electronic detonator.

As a second specific embodiment of the charging control circuit in the invention, the charging control circuit includes a fifth PMOS transistor, a sixth PMOS transistor, a seventh PMOS transistor, a seventh NMOS transistor, an eighth NMOS transistor, a ninth NMOS transistor, a seventh resistor, and a sixth diode. The detailed connection is described as follows:

The source and the substrate of the fifth PMOS transistor are connected to the power supply management circuit; the grid of the fifth PMOS transistor, the grid of the seventh NMOS transistor, and the grid of the eighth NMOS transistor are jointly connected to the logic control circuit; the drain of the fifth PMOS transistor, the drain of the seventh NMOS transistor, and the grid of the ninth NMOS transistor connect together. The source and the substrate of the sixth PMOS transistor, the substrate of the seventh PMOS transistor, and one end of the seventh resistor are connected to the rectifier bridge circuit together; the other end of the seventh resistor is connected to the source of the seventh PMOS transistor; the grid of the sixth PMOS transistor, the drain of the seventh PMOS transistor, and the drain of the ninth NMOS transistor are jointly connected to the anode of the sixth diode; the cathode of the sixth diode is connected to the third pin within the chip; the drain of the sixth PMOS transistor, the drain of the eighth NMOS transistor, and the grid of the seventh PMOS transistor connect together. The source and the substrate of the seventh NMOS transistor, the source and the substrate of the eighth NMOS transistor, and the source and the substrate of ninth NMOS transistor are grounded together.

The second embodiment is further improved based on the first. Because voltage drop caused by a resistor is proportional to the current, connection of the seventh resistor in the first embodiment is changed, making the seventh resistor play the role of limiting current and adjusting the voltage drop between the grid and the source of the seventh PMOS transistor which acts as a charging control switch. This makes the voltage between the grid and the source of the seventh PMOS transistor inversely proportional to the charging current, thus making the charging current more stable, even realizing constant-current charging in case of appropriate parameters selection. And it can decrease the maximum charging current during a certain charging time, thereby reducing the impact of the charging process on the electronic detonator network, making the electronic detonator network more stable.

As a third embodiment of the charging control circuit in the invention, the charging control circuit includes a fifth PMOS transistor, a sixth PMOS transistor, a seventh PMOS transistor, a seventh NMOS transistor, an eighth NMOS transistor, a ninth NMOS transistor, a seventh resistor, and a sixth diode. The detailed connection is described as follows:

The source and the substrate of the fifth PMOS transistor are connected to the power supply management circuit; the grid of the fifth PMOS transistor, the grid of the seventh NMOS transistor, and the grid of the eighth NMOS transistor are jointly connected to the logic control circuit; the drain of the fifth PMOS transistor, the drain of the seventh NMOS transistor, and the grid of the ninth NMOS transistor connect together. The source and the substrate of the sixth PMOS transistor, and the source and the substrate of the seventh PMOS transistor are jointly connected to one end of the seventh resistor; the other end of the seventh resistor is connected to the rectifier bridge circuit; the grid of the sixth PMOS transistor, the drain of the seventh PMOS transistor, and the drain of the ninth NMOS transistor are jointly connected to the anode of the sixth diode; the cathode of the sixth diode is connected to the third pin within the chip; the drain of the sixth PMOS transistor, the drain of the eighth NMOS transistor, and the grid of the seventh PMOS transistor connect together. The source and the substrate of the seventh NMOS transistor, the source and the substrate of the eighth NMOS transistor, and the source and the substrate of the ninth NMOS transistor are grounded together.

The third embodiment is further improved based on the first one. The seventh resistor acting as a current limiting resistor is connected between the output terminal of the rectifier bridge circuit, and the sixth PMOS transistor and the seventh PMOS transistor. The seventh resistor is adopted to limit the current impact at the turning-over moment of the branch including the two PMOS transistors, thus reducing the noise of the electronic detonator network and making the whole system more stable.

As a fourth embodiment of the charging control circuit in the invention, the charging control circuit includes a fifth PMOS transistor, a sixth PMOS transistor, a seventh PMOS transistor, a seventh NMOS transistor, an eighth NMOS transistor, a ninth NMOS transistor, a seventh resistor, an eighth resistor, a ninth resistor, and a sixth diode. The detailed connection is described as follows:

The source and the substrate of the fifth PMOS transistor are connected to the power supply management circuit; the grid of the fifth PMOS transistor, the grid of the seventh NMOS transistor, and the grid of the eighth NMOS transistor are jointly connected to the logic control circuit; the drain of the fifth PMOS transistor, the drain of the seventh NMOS transistor, and the grid of the ninth NMOS transistor connect together. The drain of the seventh PMOS transistor and the drain of the ninth NMOS transistor are both connected to one end of the seventh resistor; the other end of the seventh resistor is connected to the anode of the sixth diode. The source and the substrate of the sixth PMOS transistor, and the source and the substrate of the seventh PMOS transistor are jointly connected to the rectifier bridge circuit; the drain of the sixth PMOS transistor is connected to one end of the eighth resistor; the other end of the eighth resistor is connected to the grid of the seventh PMOS transistor, and this end is also connected to one end of the ninth resistor; the other end of the ninth resistor is connected to the drain of the eighth NMOS transistor; the grid of the sixth PMOS transistor and the cathode of the sixth diode are connected to the third pin within the chip. The source and the substrate of the seventh NMOS transistor, the source and the substrate of the eighth NMOS transistor, and the source and the substrate of the ninth NMOS transistor are grounded together.

The fourth embodiment is further improved based on the first one. Use of the ninth NMOS transistor is to improve electronic detonator security; in addition, as the grid of the sixth PMOS transistor is connected to the anode of the capacitor in the storage unit, the voltage between the grid and the source of the sixth PMOS transistor decreases as the voltage of the capacitor increases, which making the equivalent resistance of the sixth PMOS transistor gradually increase in the charging process, and finally cut off completely. The eighth resistor and the ninth resistor are adopted to divide the voltage, which, on the one hand, realizes dynamic control of the voltage of the grid of the seventh PMOS transistor that is conducive to maintaining stable charging current, thereby improving the stability of the electronic detonator network; and on the other hand, can ensure that there is always one MOS transistor of the two MOS transistors of each branch in the state of cut-off both before and after charging, thereby reducing the static operating current of the electronic detonator control chip and improving utilization efficiency of the energy supplied by the external detonation apparatus.

As a fifth embodiment of the charging control circuit in the invention, the charging control circuit includes a fifth PMOS transistor, a sixth PMOS transistor, a seventh PMOS transistor, a seventh NMOS transistor, an eighth NMOS transistor, a ninth NMOS transistor, a seventh resistor, an eighth resistor, a ninth resistor, and a sixth diode. The detailed connection is described as follows:

The source and the substrate of the fifth PMOS transistor are connected to the power supply management circuit; the grid of the fifth PMOS transistor, the grid of the seventh NMOS transistor, and the grid of the eighth NMOS transistor are jointly connected to the logic control circuit; the drain of the fifth PMOS transistor, the drain of the seventh NMOS transistor, and the grid of the ninth NMOS transistor connect together. The source and the substrate of the sixth PMOS transistor, and the source and the substrate of the seventh PMOS transistor are connected to one end of the seventh resistor; the other end of the seventh resistor is connected to the rectifier bridge circuit; the drain of the sixth PMOS transistor is connected to one end of the eighth resistor; the other end of the eighth resistor is connected to the grid of the seventh PMOS transistor, and also connected to one end of the ninth resistor; the other end of the ninth resistor is connected to the drain of the eighth NMOS transistor; the grid of the sixth PMOS transistor and the cathode of the sixth diode are connected to the third pin. The drain of the seventh PMOS transistor, the drain of the ninth NMOS transistor, and the anode of the sixth diode connect together. The source and the substrate of the seventh NMOS transistor, the source and the substrate of the eighth NMOS transistor, and the source and the substrate of the ninth NMOS transistor are grounded together.

The fifth embodiment is further improved based on the first one. The seventh resistor acting as a current limiting resistor is used to limit current impact at the turning-over moment of the branch including the sixth PMOS transistor and the seventh PMOS transistor, thus reducing the noise of the electronic detonator network and enhancing the stability of the electronic detonator network.

As a sixth embodiment of the charging control circuit in the invention, the charging control circuit includes a fifth PMOS transistor, a sixth PMOS transistor, a seventh PMOS transistor, a seventh NMOS transistor, an eighth NMOS transistor, a ninth NMOS transistor, a seventh resistor, an eighth resistor, a ninth resistor, and a sixth diode. The detailed connection is described as follows:

The source and the substrate of the fifth PMOS transistor are connected to the power supply management circuit; the grid of the fifth PMOS transistor, the grid of the seventh NMOS transistor, and the grid of the eighth NMOS transistor are jointly connected to the logic control circuit; the drain of the fifth PMOS transistor, the drain of the seventh NMOS transistor, and the grid of the ninth NMOS transistor connect together. The source and the substrate of the sixth PMOS transistor, the substrate of the seventh PMOS transistor, and one end of the seventh resistor are jointly connected to the rectifier bridge circuit; the other end of the seventh resistor is connected to the source of the seventh PMOS transistor; the grid of the sixth PMOS transistor and the cathode of the sixth diode are jointly connected to the third pin; the drain of the sixth PMOS transistor is connected to one end of the eighth resistor; the other end of the eighth resistor is connected to the grid of the seventh PMOS transistor, and this end is also connected to one end of the ninth resistor; the other end of the ninth resistor is connected to the drain of the eighth NMOS transistor. The drain of the seventh PMOS transistor, the drain of the ninth NMOS transistor, and the anode of the sixth diode connect together. The source and the substrate of the seventh NMOS transistor, the source and the substrate of the eighth NMOS transistor, and the source and the substrate of the ninth NMOS transistor are jointly grounded.

The sixth embodiment is further improved based on the first. Degenerative feedback of the seventh resistor acting as current limiting resistor is used to further improve the smoothness of the charging current, thereby enhancing the stability of electronic detonator network.

In another embodiment of this invention, the chip further includes a firing drive circuit. One end of the firing drive circuit is connected to the third pin, and one end is grounded; and the firing drive circuit is connected in series between the logic control circuit and the firing control circuit via the other two ends of the firing drive circuit. Or, one end of the firing drive circuit is connected to the third pin, one end is connected the fourth pin, and one end is grounded; and the firing drive circuit is connected in series between the logic control circuit and the firing control circuit via the other two ends of the firing drive circuit.

The firing drive circuit is connected between the logic control circuit and the firing control circuit, and makes the control signal at low-level output by the logic control circuit be converted to a control signal at high-level by the firing drive circuit, and then the control signal at high-level is output to the firing control circuit by the firing drive circuit. This increases the drive voltage that conducts a MOS transistor or a thyristor in the firing control circuit, thus reducing the conduction resistance of the MOS transistor or thyristor. Thereby, on the one hand, it improves the utilization rate of the ignition energy stored in the storage unit; on the other hand, it reduces discharging time of the ignition capacitor and increases the ignition time precision of the electronic detonator.

As the first specific embodiment of the firing drive circuit that can work without power supply, the firing drive circuit includes an eighth PMOS transistor, a tenth NMOS transistor, a tenth resistor, and an eleventh resistor. Wherein, the source and the substrate of the eighth PMOS transistor and one end of the tenth resistor connect together, and are jointly connected to the third pin; the grid of the eighth PMOS transistor, the other end of the tenth resistor, and the drain of the tenth NMOS transistor connect together; the drain of the eighth PMOS transistor and one end of the eleventh resistor connect together, and are jointly connected to the grid of the second NMOS transistor; the other end of the eleventh resistor is grounded; the source and the substrate of the tenth NMOS transistor are grounded, with its grid connected to the logic control circuit. Resistance of the tenth resistor and eleventh resistor is preferred not less than 100 KΩ.

This embodiment realizes the basic functions of the firing drive circuit. In addition, the PMOS transistor and the NMOS transistor are both conducted when the firing drive circuit is working, so that the tenth resistor, the eleventh resistor and the ignition unit are connected in parallel. Therefore, when the firing drive circuit works, if the resistance of the two resistors is taken as not less than 100 KΩ, the discharging time of the ignition capacitor can be reduced, as well as the consumption of energy stored in the ignition capacitor caused by the operation of the firing drive circuit. The greater the resistance of the resistors is, the less the energy consumption will be.

As a second specific embodiment of the firing drive circuit that can work without power supply, the firing drive circuit includes a ninth PMOS transistor, a twelfth resistor, an eleventh NMOS transistor, and a twelfth NMOS transistor. Wherein, the source and the substrate of the ninth PMOS transistor and one end of the twelfth resistor connect together, and are connected to the third pin together; the other end of the twelfth resistor, the grid of the ninth PMOS transistor, the drain of the eleventh NMOS transistor, and the grid of the twelfth NMOS transistor connect together; the drain of the Ninth PMOS transistor and the drain of the twelfth NMOS transistor connect together, with both connected to the grid of the second NMOS transistor; the source and the substrate of the eleventh NMOS transistor, and the source and the substrate of the twelfth NMOS transistor are grounded; the grid of the eleventh NMOS transistor is connected to the logic control circuit. Resistance of the twelfth resistor is preferred not less than 100 KΩ.

The eleventh resistor is replaced by the twelfth NMOS transistor in this embodiment based on the first. Characteristic of small conduction resistance of an NMOS transistor is adopted in this embodiment to realize a more reliable pull-down of the firing drive circuit in the non-ignition state; at the same time, characteristic of large cut-off resistance of an NMOS transistor is adopted to reduce leakage current existing in the first embodiment. Meanwhile, in the field of integrated circuit design, the area that a large resistor occupies is much larger than an NMOS transistor occupies, so adoption of NMOS transistors can also reduce areas occupied when the firing drive circuit is integrated.

As a first embodiment of the firing drive circuit that need to work with power supply, the firing drive circuit includes a first inverter, a tenth PMOS transistor, an eleventh PMOS transistor, a thirteenth NMOS transistor, and a fourteenth NMOS transistor. Wherein, the source and the substrate of the tenth PMOS transistor, and the source and the substrate of the eleventh PMOS transistor connect together, and are jointly connected to the third pin; the drain of the tenth PMOS transistor, the grid of the eleventh PMOS transistor, and the drain of the thirteenth NMOS transistor connect together; the grid of the tenth PMOS transistor, the drain of the eleventh PMOS transistor, and the drain of the fourteenth NMOS transistor connect together, and are connected to the grid of the second NMOS transistor. The source and the substrate of the thirteenth NMOS transistor, and the source and the substrate of the fourteenth NMOS transistor are grounded; the grid of the thirteenth NMOS transistor and the input terminal of the first inverter connect together, and are jointly connected to the logic control circuit; the grid of the fourteenth NMOS transistor is connected to the output terminal of the first inverter. The power supply input terminal of the first inverter is connected to the fourth pin, powered by the power supply management circuit; the other end of the first inverter is grounded.

The twelfth resistor used for pull-up is replaced by the tenth PMOS transistor in this embodiment based on the second embodiment of the firing drive circuit that can work without power supply, which realizes that no matter what state the firing drive circuit is in, there is always one MOS transistor in the state of cut-off of each branch composed of one PMOS transistor and one NMOS transistor, thus avoiding the existence of leakage current of the firing drive circuit. Meanwhile, this embodiment also further reduces areas occupied when the firing drive circuit is integrated.

As a second embodiment of the firing drive circuit that need to work with power supply, based on the first embodiment, the firing drive circuit further includes a fifteenth NMOS transistor. The drain of the fifteenth NMOS transistor, and the power supply input terminal of the first inverter connect together, and are jointly connected to the fourth pin, powered by the power supply management circuit; the source of the fifteenth NMOS transistor, the grid of the tenth PMOS transistor, the drain of the eleventh PMOS transistor, and the drain of the fourteenth NMOS transistor connect together, and are jointly connected to the grid of the second NMOS transistor; the grid of the fifteenth NMOS transistor, the grid of the thirteenth NMOS transistor, and the input terminal of the first inverter connect together, and are jointly connected to the logic control circuit; the substrate of the fifteenth NMOS transistor is grounded.

The advantages of this embodiment lie in: as the drive power of the firing drive circuit is supplied by the ignition capacitor, when the detonator ignites and when the voltage of the ignition capacitor drops to the voltage around the threshold voltage of the eleventh PMOS transistor, the equivalent resistance of the eleventh PMOS transistor will increase sharply, and at the same time the eleventh PMOS transistor will basically fail to drive the firing control circuit, so that energy in the ignition capacitor will not fully release; but the fifteenth NMOS transistor can still drive the firing control circuit in this case, because power supply that drives the fifteenth NMOS transistor comes from operating voltage of the logic control circuit, which can fully release the ignition energy stored in the ignition capacitor and further improve the utilization rate of energy stored in the ignition capacitor.

In another embodiment of this invention, the communication interface circuit further includes a data modulation module and a data demodulation module, wherein the data demodulation module is composed of two data demodulation circuits. The two data demodulation circuits are connected to the first pin respectively, the two data demodulation circuits are connected to the logic control circuit respectively, the two data demodulation circuits are connected to the fourth pin together within the chip, and the two data demodulation circuits are also grounded together. One end of the data modulation module is connected to the logic control circuit, one end is grounded, and the other two ends are connected to the first pin respectively.

The advantages of the communication interface circuit lie in: the two data demodulation circuits adopted are exactly the same and independent; they are connected to the first pin respectively, and then further connected to the detonator wires respectively. So the electronic detonator can receive both unipolar signal and bipolar signal output by the external detonation apparatus. This realizes good adoptability and applicability of the electronic detonator in different detonation systems with different communication requirements.

The data modulation module can further include a thirteenth resistor, a fourteenth resistor, a fifteenth resistor, a sixteenth NMOS transistor, and a seventeenth NMOS transistor. The drain and the substrate of the sixteenth NMOS transistor, the drain and the substrate of the seventeenth NMOS transistor, and one end of the thirteenth resistor are grounded; the grid of the sixteenth NMOS transistor and the grid of the seventeenth NMOS transistor are connected to the other end of the thirteenth resistor, and are jointly connected to the logic control circuit; the source of the sixteenth NMOS transistor is connected to one of the set of the first pin via fourteenth resistor, the source of the seventeenth NMOS transistor is connected to the other of the set of the first pin via a fifteenth resistor.

The embodiment of the data modulation module can output the data needed to be sent to the detonator network in the form of changes of current consumption via the detonator wires. The advantages lie in: because the source of the sixteenth NMOS transistor and the source of the seventeenth NMOS transistor are grounded together, while the drain of the two NMOS transistors is connected to the detonator wires respectively, the effect of individual differences of voltage drop of the rectifier bridge circuit on consistency of current consumption changes is reduced, making the current consumption changes remitted by the electronic detonator to the detonation apparatus depend only on the voltage of the signal bus in the detonation network.

The data demodulation circuit further includes a second inverter and a sixteenth resistor. One end of the second inverter is connected to the fourth pin, one end is grounded; the input terminal of the second inverter is connected to one of the set of the first pin, and is grounded via the sixteenth resistor; and the output terminal of the second inverter is connected to the logic control circuit. The embodiment of this data demodulation circuit is extremely simple and easy to integrate. With pull-down of the sixteenth resistor, the output of this data demodulation circuit is ensured to be always in a definite state, no matter what kind of state the signal bus is in, such as state of positive voltage, negative voltage, or zero voltage, thus avoiding consumption of the energy stored in the storage unit of the electronic detonator when the input of the second inverter is in an indefinite state, and further improving the reliability of the electronic detonator system. In addition, the sixteenth resistor also provides a discharging path for residual charge of the bus when data on the bus changes, so that communication speed is improved.

As another embodiment, the data demodulation circuit can further include a second inverter and an eighteenth NMOS transistor. One end of the second inverter is connected to the fourth pin, one end is grounded, and the other two ends work as an input terminal and an output terminal respectively. The source and the substrate of the eighteenth NMOS transistor are grounded; its drain and the input terminal of the second inverter connect together, and are jointly connected to one of the set of the first pin; the grid of the eighteenth NMOS transistor and the output terminal of the second inverter connect together, and are jointly connected to the logic control circuit. The pull-down sixteenth resistor is replaced by the eighteenth NMOS transistor which is connected in the way of degenerative feedback in the data demodulation circuit, and the advantage is to avoid energy consumption caused by the sixteenth resistor and to improve utilization efficiency of the energy provided by the external detonation apparatus. In addition, characteristic of dynamic resistance of an NMOS transistor is adopted, and if the input of the bus is at low level, the output of the second inverter will be at high level, and the eighteenth NMOS transistor will be in a state of conduction. Therefore, when the communication data sent on the bus make the voltage of the bus switch from high level to low level, the eighteenth NMOS transistor can accelerate discharging of the residual charge of the bus, thus improving communication speed of the communication system.

Schmitt inverter is a better choice of the second inverter in the data demodulation circuit. The advantage is that, whether state switching of the signal input to the inverter is slow or not, that is, whether the time that level switching and transition takes is long or not, output edge of the inverter is relatively steep and time for level switching and transition of its output is incredibly short. This reduces the time for state transition of follow-up processing circuit of the data demodulation circuit and reduces the power consumption of the electronic detonator. In addition, Schmitt inverter has good anti-noise performance, which can improve the stability of the electronic detonator when receiving data.

In another embodiment of this invention, the logic control circuit includes a programmable delay module, an input/output interface, a serial communication interface, a prescaler, and a Central Processing Unit (CPU). Wherein, one end of the CPU is connected to the fourth pin, one end is grounded; and one end is connected to the programmable delay module, the prescaler and the clock circuit; the other end of the CPU is connected to the programmable delay module, the input/output interface, the serial communication interface, and the prescaler via the internal bus. One end of the programmable delay module is connected to the firing control circuit, one end is connected to the fourth pin, one end is grounded, one end is connected to the internal bus; and the other end is connected to the CPU, the prescaler and the clock circuit. One end of the input/output interface is connected to the charging control circuit, one end is connected to the safe discharging circuit, one end is connected to the fourth pin, one end is grounded, and the other end is connected to the internal bus. One end of the serial communication interface is connected to the communication interface circuit, one end is connected to the fourth pin, one end is grounded, one end is connected to the prescaler, and the other end is connected to the internal bus. One end of the prescaler is connected to the fourth pin, one end is grounded, one end is connected to the serial communication interface, one end is connected to the internal bus; and the other end is connected to the CPU, the programmable delay module and the clock circuit.

The advantages of the embodiment of the logic control circuit lie in:

1. The introduction of the programmable delay module solves the problem of the fixed delay time existing in the traditional detonator products and reflects the programmable performance of the electronic detonator, which realizes unicity of the electronic detonator control chip and types of electronic detonators, thus simplifying the process control of electronic detonators during production, distribution and use, and greatly reducing the management difficulty of the detonator products.
2. The serial communication interface and the communication interface circuit which are at the external of the logic control circuit are adopted to work together to realize the interaction of the CPU of the electronic detonator and the control apparatus at the external of the electronic detonator, and thus realizing the function of repeatedly programmable online of the electronic detonator, that is, being able to set the delay time of each detonator in-hole with the external detonation apparatus according to the specific requirements of the blasting engineering. This greatly simplifies construction complexity caused by the coercive corresponding relationship between detonators and holes in the use of detonators, and also improves the flexibility of the blasting network design.

A presettable down-counter is a better choice for the programmable delay module. After receiving the delay-time data included in the delay-time-writing instruction, the CPU can directly write the delay-time data into the presettable down-counter via the internal bus, reducing the registers' quantity demanded for temporary data in the CPU. Adopting the presettable down-counter, when it counts down to zero which means that the delay time has arrived, the delay-time data included in the delay-time-writing instruction can be directly adopted as the data written into the down-counter without any transformation. On the contrary, if a presettable up-counter is adopted, the data written into the up-counter is needed to be calculated according to the delay-time data included in the delay-time-writing instruction. The calculation process goes as follows: according to theory that the delay time arrives when the up-counter counts up to its upper limit, the data written into the up-counter is gained by subtracting the delay-time data included in the delay-time-writing instruction from the upper limit of the presettable up-counter. In summary, the adoption of the down-counter makes the design simpler.

A control process of the electronic detonator control chip is also provided in the present invention, including the following steps:

step 1, initializing the programmable delay module: the CPU sending a control signal to the programmable delay module, causing it to output a signal to cut off the firing control circuit, into a fire-forbidden state;

step 2, the CPU reading the identity code of the electronic detonator stored in the non-volatile memory;

step 3, initializing the prescaler: the CPU writing the default number of clocks of the clock circuit into the prescaler to control the communication baud rate and the sampling phase, under the condition of which the serial communication interface works;

step 4, the CPU waiting to receive instructions from an apparatus outside the electronic detonator: upon receiving a delay-time-writing instruction, performing step 5; upon receiving a firing instruction, performing step 6;

step 5, performing a delay-time-writing process; then going back to the step 4; and step 6, performing a firing process, and then ending the control process.

Wherein, the delay-time-writing process can be carried out as follows:

step one, the CPU of a particular detonator judging whether or not to set a delay time for this particular detonator according to the identity code included in the delay-time-writing instruction: if the judgment being positive, performing step two; and if the judgment being negative, ending the delay-time-writing process;

step two, the CPU writing the delay-time data included in the delay-time-writing instruction into the programmable delay module; and step three, the electronic detonator sending delay-time-writing-completed signal to the outside apparatus; and then ending the delay-time-writing process.

Wherein, the firing process is carried out as follows:

step A, the CPU sending the control signal to the programmable delay module to start it;

step B, the CPU waiting for the end of the delay time, if the delay time reaching the end, perform step C; if not, continue waiting; and step C, the programmable delay module outputting a signal to the firing control circuit to turn on the firing control circuit, rendering it into an ignition state; then ending the firing process.

The invention also relates to an electronic detonator including a control chip described above.

DETAILED DESCRIPTION OF EMBODIMENTS

The following further describes the embodiments of the present invention in more details with reference to accompanying drawings.

Figure 1:
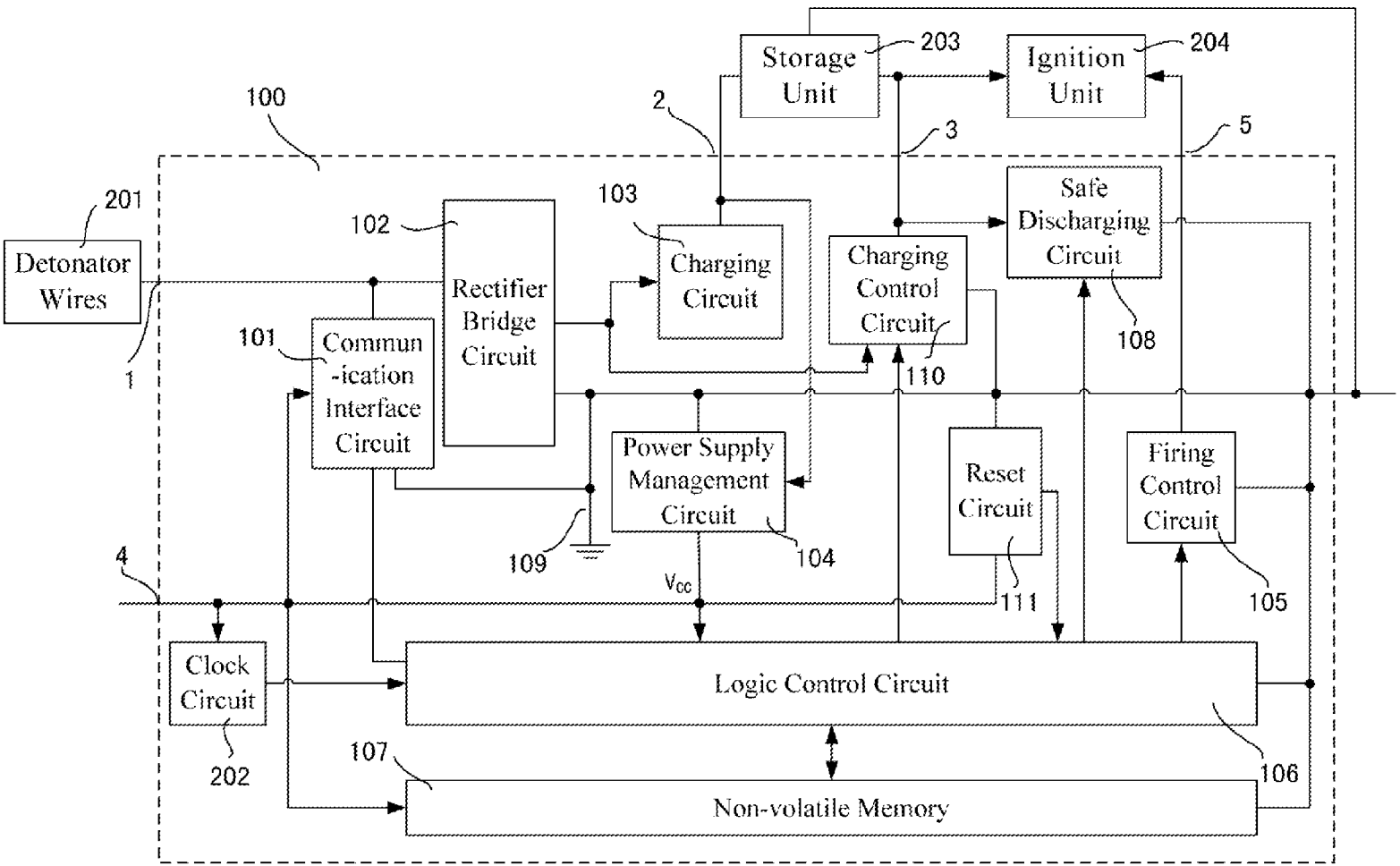
FIG. 1 is a logic diagram of the electronic detonator control chip according to the invention.
Figure 30:
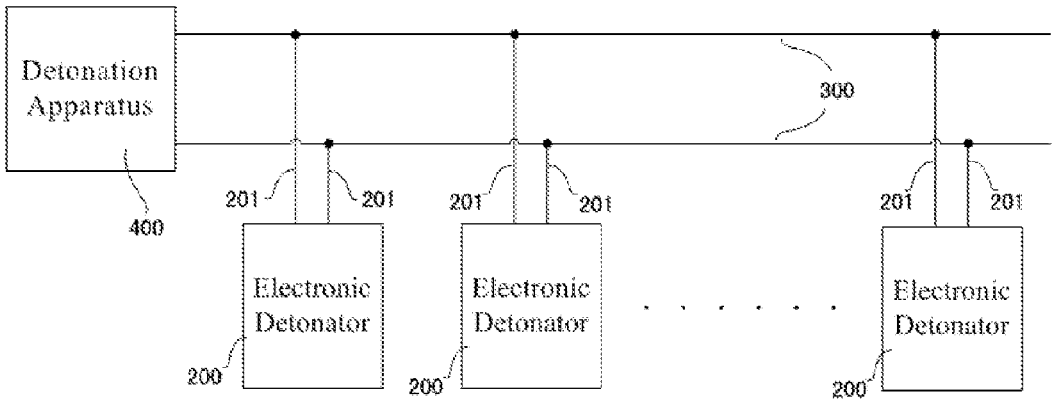
FIG. 30 is the schematic diagram of an electronic detonator detonation network composed of electronic detonators comprising the chip according to the invention.

FIG. 1 shows the logic diagram of the electronic detonator control chip 100 according to the present invention. As shown in the broken line frame in FIG. 1, the electronic detonator control chip 100 according to the invention includes a communication interface circuit 101, a rectifier bridge circuit 102, a charging circuit 103, a charging control circuit 110, a power supply management circuit 104, a firing control circuit 105, a logic control circuit 106, a non-volatile memory 107, a reset circuit 111, a safe discharging circuit 108, and a clock circuit 202. The connections and operation principles are described in details as follows:

(1) One end of the rectifier bridge circuit 102 is connected to the communication interface circuit 101, forming a set of pin 1 that extends out of the chip 100 and is connected to the detonator wires 201 at the external of the chip 100 respectively; the external detonation apparatus 400 is connected to the detonator wires 201 via the signal bus 300, and inputs energy to the chip 100 via the detonator wires 201; the external detonation apparatus 400 also communicates with the chip 100 via the signal bus 300 and the detonator wires 201, as illustrated in FIG. 30. Another end of the rectifier bridge circuit 102 leads to the charging circuit 103 and the charging control circuit 110 to supply power to them. The other end of the rectifier bridge circuit 102 is grounded to the ground 109. The rectifier bridge circuit 102 is used to realize the two-wire non-polarity connection of the electronic detonator 200, thus facilitating the blasting engineering.

(2) One end of the charging circuit 103 is connected to the rectifier bridge circuit 102; the other end is connected to the power supply management circuit 104 and also extends to the exterior of the chip 100, forming a set of pin 2, as FIG. 1 shows. The storage unit 203 embodies as two or more capacitors, wherein the one supplying power for normal operation of the chip 100 may be called digital storage capacitor, while the one supplying power for the ignition unit 204 may be called ignition capacitor. The pin 2 is used by the chip 100 to charge the digital storage capacitor of the storage unit 203; and when the external energy supply via the signal bus 300 and the detonator wires 201 is interrupted, the energy stored in the digital storage capacitor will be supplied to the chip 100 via the pin 2 and the pin 2 is further connected to the power supply management circuit 104, to ensure normal operation of the digital circuit within the chip 100 for a period of time.

(3) One end of the charging control circuit 110 is connected to the rectifier bridge circuit 102, one end is grounded to the ground 109, and one end is connected to the logic control circuit 106; another end of the charging control circuit 110 is connected to the safe discharging circuit 108 and this end also extends out of the chip 100, forming a set of pin 3, which links with the storage unit 203 outside the chip 100. The pin 3 is used to charge the ignition capacitor of the storage unit 203; and when the detonation needs cutoff, the energy stored in the ignition capacitor will go to the chip 100 via the pin 3 and will be released via the safe discharging circuit 108 in order to return to the safe state of the electronic detonator.

(4) One end of the safe discharging circuit 108 is connected to the logic control circuit 106, one end is grounded to the ground 109, and the other end is connected to the pin 3 within the chip 100, and further connected to the storage unit 203. The safe discharging circuit 108 is used to release the energy stored in the ignition capacitor under the control of the logic control circuit 106.

(5) One end of the power supply management circuit 104 is connected to the pin 2 from the interior of the chip 100, one end is connected to the ground 109; and the other end extends out of the chip 100, forming a set of pin 4 of the power supply output terminal of the chip 100. If the electronic detonator 200 demands higher delay precision, the pin 4 extending to the exterior of the chip 100 can be grounded 109 via a capacitor, constituting a decoupling circuit that is used to filter out noises of operating power supply caused by the chip 100, thus improving the delay precision of the electronic detonator 200.

(6) One end of the communication interface circuit 101 is grounded to the ground 109; one end is connected to the pin 1 within the chip 100, and further connected to the detonator wires 201 and the signal bus 300 at the external of the chip 100 as illustrated in FIG. 1 and FIG. 30. Another end of the communication interface circuit 101 leads to the logic control circuit 106, and the other end is connected to the pin 4 from the interior of the chip 100. The communication interface circuit 101 is used to realize the communication between the electronic detonator 200 and the external detonation apparatus 400, namely, the bidirectional communication for the electronic detonator blasting network.

(7) One end of the reset circuit 111 is grounded to the ground 109, one end is connected to the pin 4 within the chip 100, and the other end is connected to the logic control circuit 106. The reset circuit 111 is to provide the initial state for the chip 100 in order to avoid logic confusion within the chip 100.

(8) One end of the firing control circuit 105 is grounded to the ground 109, one end extends to the exterior of the chip 100, forming a set of pin 5, and the other end leads to the logic control circuit 106. The pin 5 of the chip 100 is connected to one end of the ignition unit 204 at the external of the chip 100, and the other end of the ignition unit 204 is connected to positive pole of the ignition capacitor with reference to FIG. 1. The firing control circuit 105 is to make the ignition unit 204 get grounded via the pin 5 connected to the firing control circuit 105 under the control of the logic control circuit 106, thus forming a firing loop, and energy stored in the ignition capacitor will be quickly released via the ignition unit 204 to complete the detonation.

(9) One end of the clock circuit 202 is connected to the pin 4, and the other end leads to the logic control circuit 106, providing the logic control circuit 106 with clock signals.

(10) As illustrated in FIG. 1, one end of the logic control circuit 106 is connected to the clock circuit 202, one end is connected to the pin 4 from the interior of the chip 100, one end is grounded to the ground 109, one end is connected to the non-volatile memory 107, one end is connected to the communication interface circuit 101, one end is connected to the charging control circuit 110, one end is connected to the reset circuit 111, one end is connected to the safe discharging circuit 108, and the other end is connected to the firing control circuit 105.

(11) One end of the non-volatile memory 107 is connected to the pin 4, one end is connected to the logic control circuit 106, and the other end is grounded to the ground 109.

Figure 2:
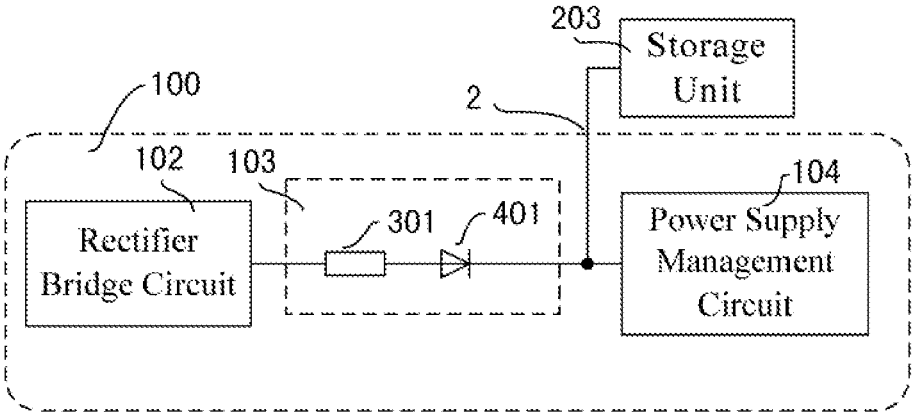
FIG. 2 is an embodiment of the charging circuit of the chip according to the invention.

As the first aspect of this invention illustrated in FIG. 2, the charging circuit 103 includes a resistor 301 and a diode 401 in series. The cathode of the diode 401 is connected to the power supply management circuit 104, and extends to the exterior of the chip 100, forming the pin 2. Resistance of the resistor 301 is preferably between 1 and 10 KΩ.

Figure 3:
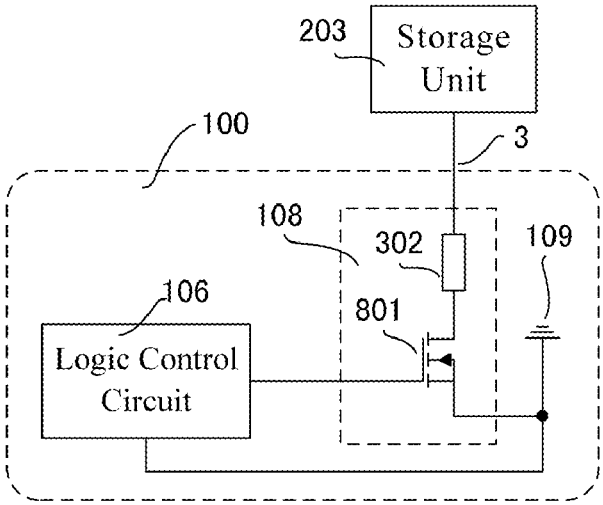
FIG. 3 is an embodiment of the safe discharging circuit of the chip according to the invention.

As the second aspect of this invention illustrated in FIG. 3, the safe discharging circuit 108 includes a resistor 302 and an NMOS transistor 801. The source and the substrate of the NMOS transistor 801 are grounded to the ground 109; the drain of the NMOS transistor 801 is connected to the pin 3 via the resistor 302, which is further connected to the ignition capacitor of the storage unit 203, and the grid of the NMOS transistor 801 is connected to the logic control circuit 106. Resistance of the resistor 302 is preferably between 1 and 10 KΩ.

Figure 4:
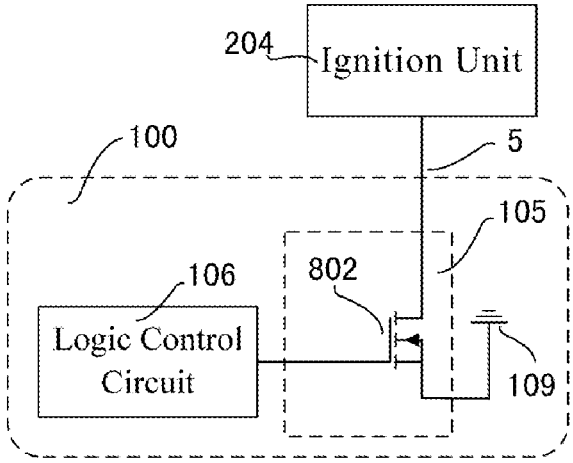
FIG. 4 is an embodiment of the firing control circuit of the chip according to the invention.

As the third aspect of this invention illustrated in FIG. 4, the firing control circuit 105 includes an NMOS transistor 802. The source and the substrate of the NMOS transistor 802 are grounded to the ground 109, the drain is connected to the pin 5, and the grid is connected to the logic control circuit 106.

Figure 5:
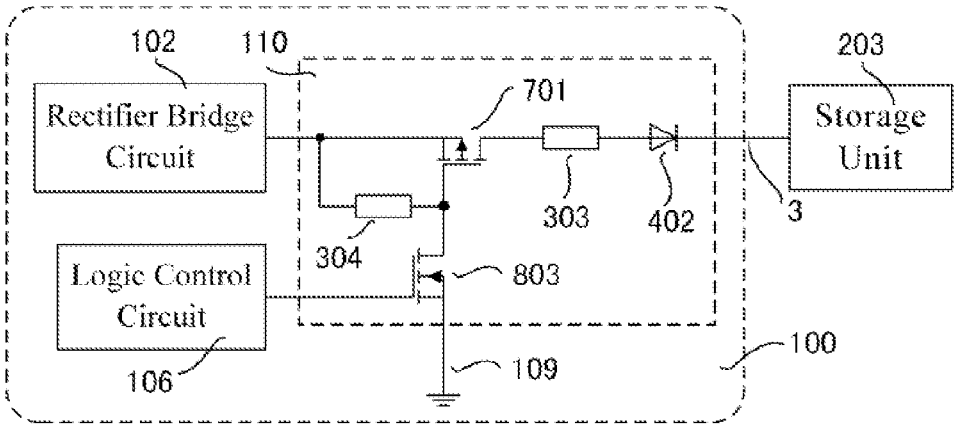
FIG. 5 is an embodiment of the charging control circuit working without power supply of the chip according to the invention.

As the fourth aspect of this invention illustrated in FIG. 5, the charging control circuit 110 includes a resistor 303, a resistor 304, a diode 402, a PMOS transistor 701, and an NMOS transistor 803. The source and the substrate of the NMOS transistor 803 are grounded to the ground 109, its grid is connected to the logic control circuit 106, and its drain is connected to the grid of the PMOS transistor 701. The source and the substrate of the PMOS transistor 701 are connected to the rectifier bridge circuit 102, and its drain is connected to the pin 3 via the resistor 303 and the diode 402 in series with cathode of the diode 402 towards the pin 3; the resistor 304 crosses over the substrate of the PMOS transistor 701 and the drain of the NMOS transistor 803. Resistance of the resistor 303 and the resistor 304 is preferred between 1 and 10 KΩ.

Figure 6:
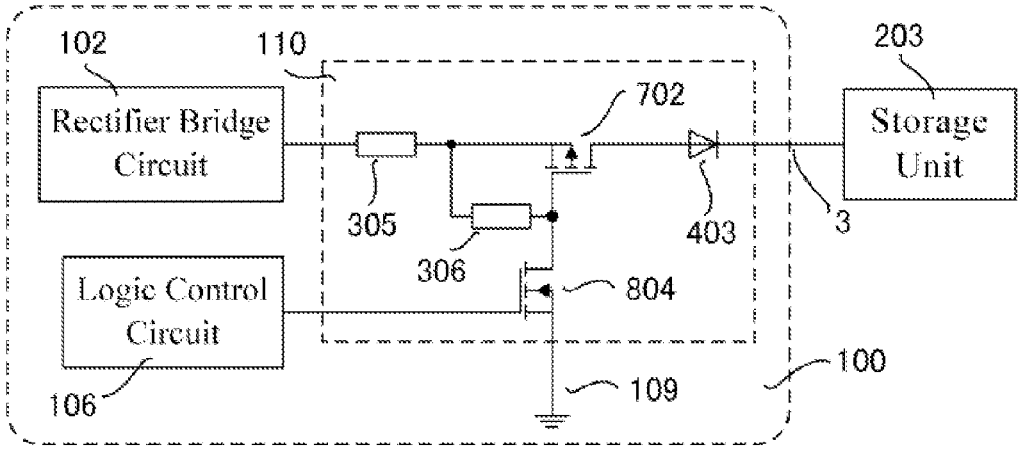
FIG. 6 is another embodiment of the charging control circuit working without power supply of the chip according to the invention.

As illustrated in FIG. 6, as another embodiment of the charging control circuit 110, the charging control circuit 110 includes a resistor 305, a resistor 306, a diode 403, a PMOS transistor 702, and an NMOS transistor 804. The source and the substrate of the NMOS transistor 804 are grounded to the ground 109, its grid is connected to the logic control circuit 106, and its drain is connected to the grid of the PMOS transistor 702. The Source and the substrate of the PMOS transistor 702 are connected to the rectifier bridge circuit 102 via the resistor 305; its drain is connected to the pin 3 via the diode 403, with the cathode of the diode 403 towards the pin 3; the resistor 306 crosses over the substrate of the PMOS transistor 702 and the drain of the NMOS transistor 804. Resistance of the resistor 305 and the resistor 306 is preferably between 1 and 10 KΩ.

Figure 7:
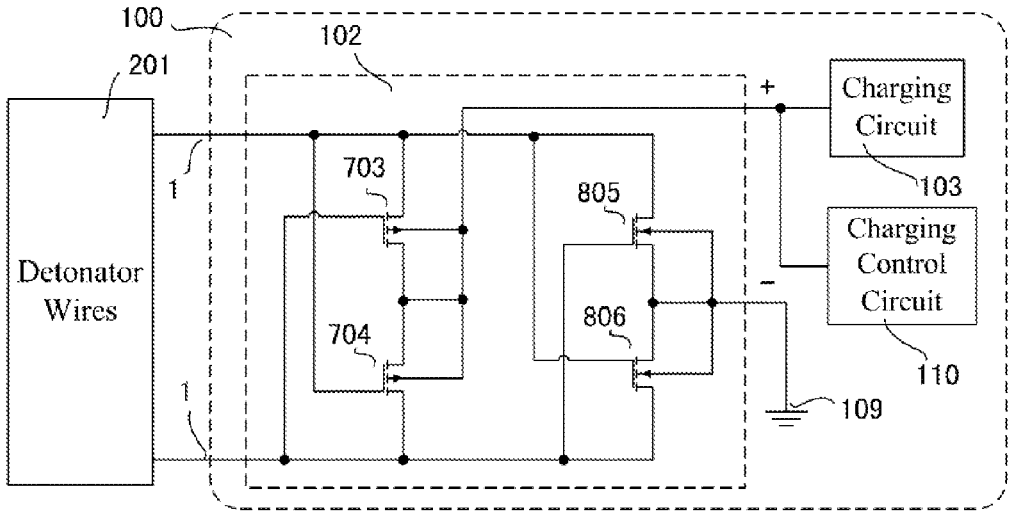
FIG. 7 is an embodiment of the rectifier bridge circuit of the chip according to the invention.
Figure 8:
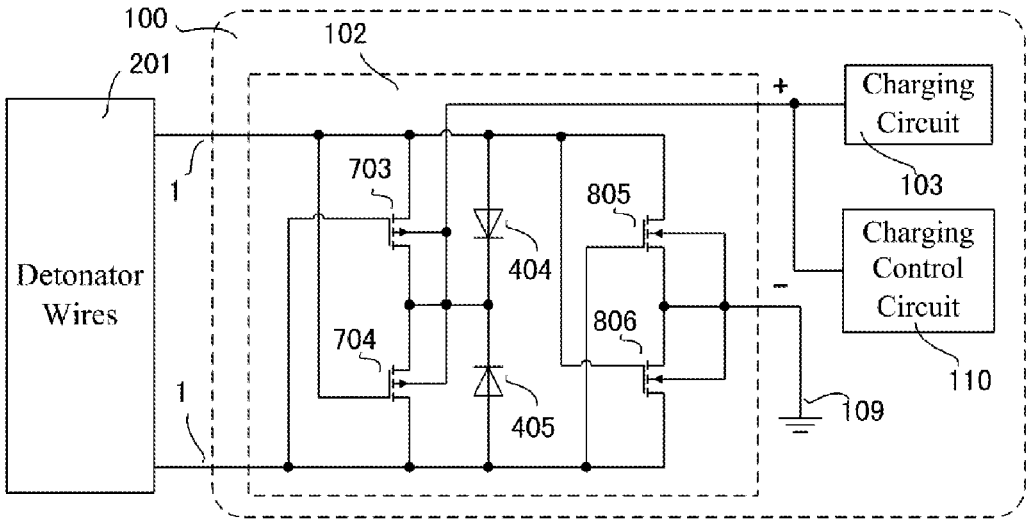
FIG. 8 is another embodiment of the rectifier bridge circuit of the chip according to the invention.

As the fifth aspect of the invention illustrated in FIG. 7, the rectifier bridge circuit 102 includes a PMOS transistor 703, a PMOS transistor 704, an NMOS transistor 805, and an NMOS transistor 806. The drain and the substrate of the PMOS transistor 703, and the drain and the substrate of the PMOS transistor 704 connect together, and are connected to the charging circuit 103 and the charging control circuit 110 together. The source and the substrate of the NMOS transistor 805 and the source and the substrate of the NMOS transistor 806 connect together, and are grounded to the ground 109 simultaneously. The source of the PMOS transistor 703, the grid of the PMOS transistor 704, the drain of the NMOS transistor 805, and the grid of the NMOS transistor 806 connect together, and extend to the exterior of the chip 100, forming one of the two pins 1; the source of the PMOS transistor 704, the grid of the PMOS transistor 703, the drain of the NMOS transistor 806, and the grid of the NMOS transistor 805 connect together, and extend to the exterior of the chip 100, forming the other pin 1.

As the grids and the sources of the two PMOS transistors have opposite voltage phases, or the grids and the sources of the two NMOS transistors have opposite voltage phases, there are always one PMOS transistor and one NMOS transistor that are on simultaneously among the two PMOS transistors and the two NMOS transistors. In addition, the voltage phases of the threshold voltage of the PMOS transistor and the NMOS transistor are opposite, which ensures the PMOS transistor and the NMOS transistor whose grids are connected to different input terminals to be on simultaneously, performing the function of the rectifier bridge circuit 102.

As a improvement to the embodiment of the rectifier bridge circuit 102 shown in FIG. 7, the rectifier bridge circuit 102 further includes a diode 404 and a diode 405, wherein the anode of the diode 404 and the anode of the diode 405 are both connected to the pin 1 respectively; the cathode of the diode 404 and the cathode of the diode 405 connect together, with both connected to the drain and the substrate of the PMOS transistor 703, as well as the drain and the substrate of the PMOS transistor 704.

Figure 9:
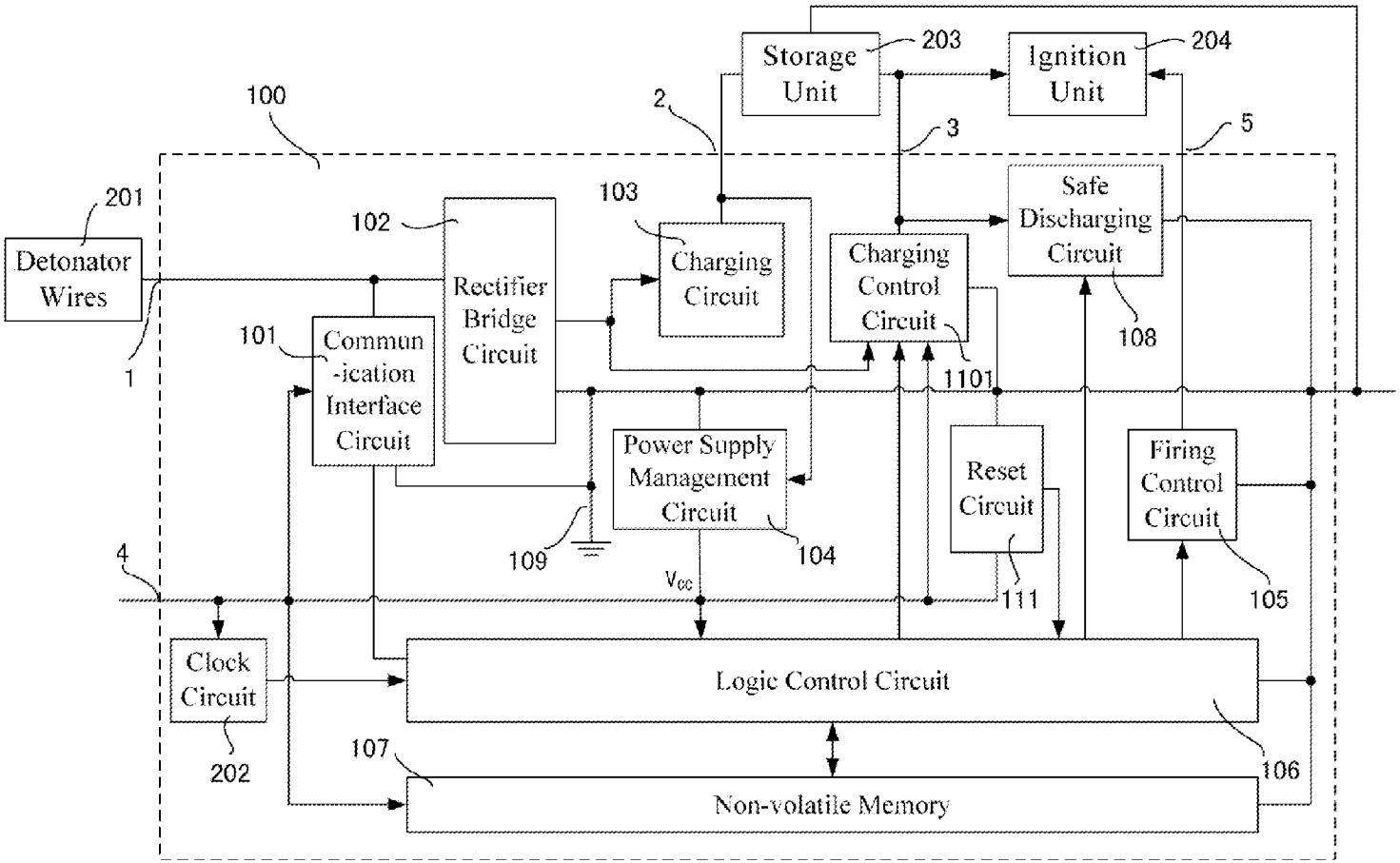
FIG. 9 is a logic diagram of the control chip according to the invention when the charging control circuit needing power supply.

As the sixth aspect of this invention illustrated in FIG. 9, the charging control circuit 1101 has another end that is connected to the pin 4 within the chip 100, i.e., it is connected to the power supply management circuit 104, and the charging control circuit 1101 is powered by the power supply management circuit 104.

Figure 10:
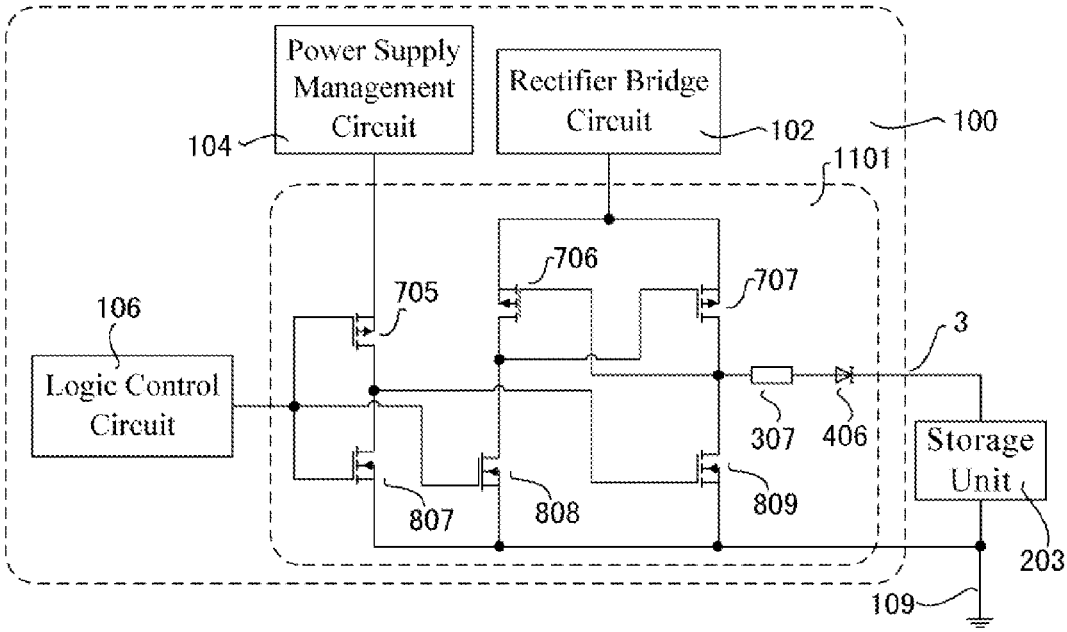
FIG. 10 is the first embodiment of the charging control circuit of the chip according to the invention when needing power supply.

As a first embodiment of the charging control circuit 1101, as shown in FIG. 10, the charging control circuit 1101 includes a PMOS transistor 705, a PMOS transistor 706, a PMOS transistor 707, an NMOS transistor 807, an NMOS transistor 808, an NMOS transistor 809, a resistor 307, and a diode 406. The detailed connection is described as follows:

The source and the substrate of the PMOS transistor 705 are connected to the power supply management circuit 104, the grid of the PMOS transistor 705, the grid of the NMOS transistor 807 and the grid of the NMOS transistor 808 are connected to the logic control circuit 106 together. The drain of the PMOS transistor 705, the drain of the NMOS transistor 807 and the grid of the NMOS transistor 809 connect together. The source and the substrate of the PMOS transistor 706, and the source and the substrate of the PMOS transistor 707 connect together, and are connected to the rectifier bridge circuit 102 together. The grid of the PMOS transistor 706, the drain of the PMOS transistor 707 and the drain of the NMOS transistor 809 are jointly connected to one end of the resistor 307, while the other end of the resistor 307 is connected to the anode of the diode 406, and the cathode of the diode 406 is connected to the pin 3 within the chip 100. The drain of the PMOS transistor 706, the grid of the PMOS transistor 707, and the drain of the NMOS transistor 808 connect together. The source and the substrate of the NMOS transistor 807, the source and the substrate of the NMOS transistor 808, and the source and the substrate of the NMOS transistor 809 are grounded to the ground 109 together.

Figure 11:
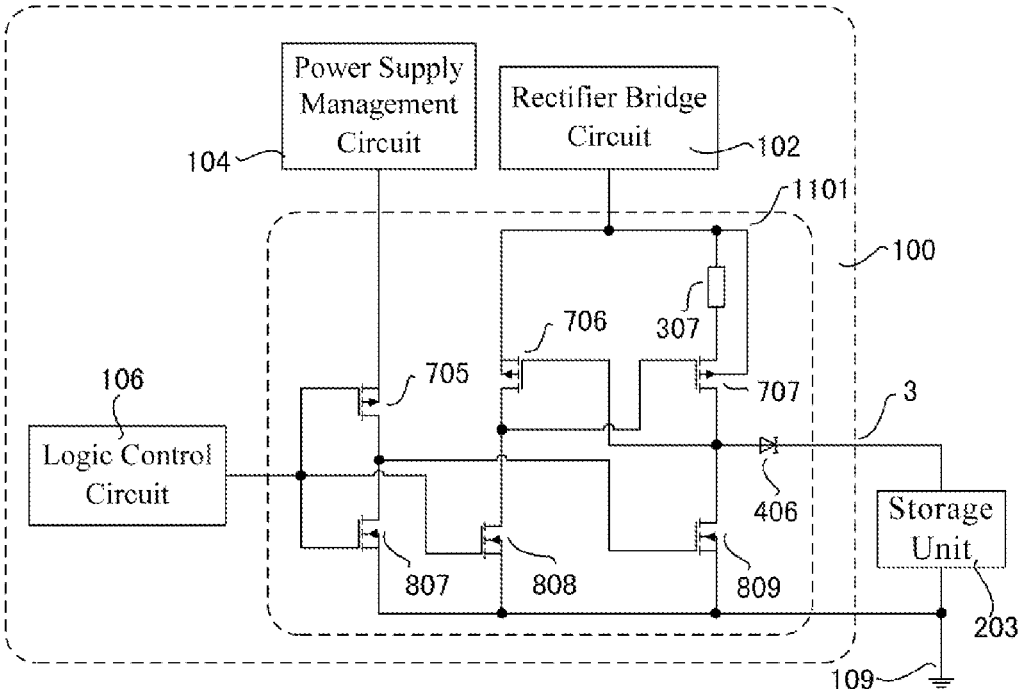
FIG. 11 is the second embodiment of the charging control circuit of the chip according to the invention when needing power supply.

As a second embodiment of the charging control circuit 1101, as shown in FIG. 11, the charging control circuit 1101 includes a PMOS transistor 705, a PMOS transistor 706, a PMOS transistor 707, an NMOS transistor 807, an NMOS transistor 808, an NMOS transistor 809, a resistor 307, and a diode 406. The detailed connection is described as follows:

The source and the substrate of the PMOS transistor 705 are connected to the power supply management circuit 104. The grid of the PMOS transistor 705, the grid of the NMOS transistor 807 and the grid of the NMOS transistor 808 are connected to the logic control circuit 106 together. The drain of the PMOS transistor 705, the drain of the NMOS transistor 807 and the grid of the NMOS transistor 809 connect together. The source and the substrate of the PMOS transistor 706, the substrate of the PMOS transistor 707 and one end of the resistor 307 are connected to the rectifier bridge circuit 102 together; while the other end of the resistor 307 is connected to the source of the PMOS transistor 707. The grid of the PMOS transistor 706, the drain of the PMOS transistor 707, and the drain of the NMOS transistor 809 are jointly connected to the anode of the diode 406; while the cathode of the diode 406 is connected to the pin 3 within the chip 100. The drain of the PMOS transistor 706, the drain of the NMOS transistor 808, and the grid of the PMOS transistor 707 connect together. The source and the substrate of the NMOS transistor 807, the source and the substrate of the NMOS transistor 808, and the source and the substrate of NMOS transistor 809 are grounded to the ground 109 together.

Figure 12:
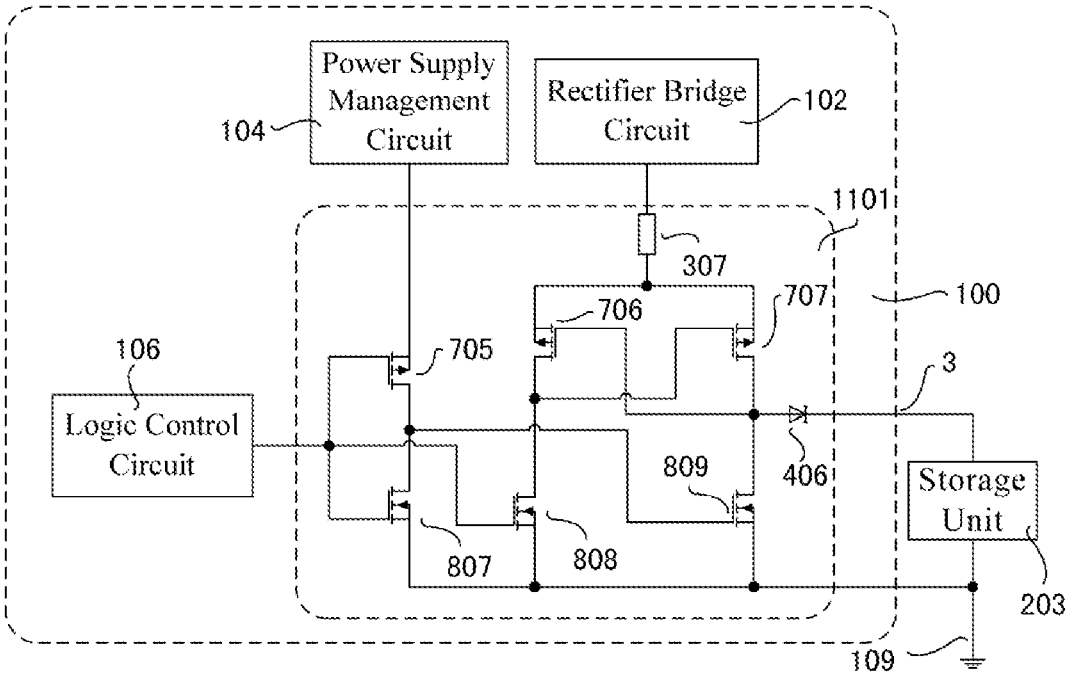
FIG. 12 is the third embodiment of the charging control circuit of the chip according to the invention when needing power supply.

As a third embodiment of the charging control circuit 1101, as shown in FIG. 12, the charging control circuit 1101 includes a PMOS transistor 705, a PMOS transistor 706, a PMOS transistor 707, an NMOS transistor 807, an NMOS transistor 808, an NMOS transistor 809, a resistor 307, and a diode 406. The detailed connection is described as follows:

The source and the substrate of the PMOS transistor 705 are connected to the power supply management circuit 104; the grid of the PMOS transistor 705, the grid of the NMOS transistor 807, and the grid of the NMOS transistor 808 are connected to the logic control circuit 106 together; the drain of the PMOS transistor 705, the drain of the NMOS transistor 807, and the grid of the NMOS transistor 809 connect together. The source and the substrate of the PMOS transistor 706, and the source and the substrate of the PMOS transistor 707 are connected to one end of the resistor 307 together, while the other end of the resistor 307 is connected to the rectifier bridge circuit 102. The grid of the PMOS transistor 706, the drain of the PMOS transistor 707, and the drain of the NMOS transistor 809 are connected to the anode of the diode 406. The cathode of the diode 406 is connected to the pin 3 within the chip 100; the drain of the PMOS transistor 706, the drain of the NMOS transistor 808, and the grid of the PMOS transistor 707 connect together. The source and the substrate of the NMOS transistor 807, the source and the substrate of the NMOS transistor 808, and the source and the substrate of the NMOS transistor 809 are grounded to the ground 109 together.

In the embodiments shown in FIG. 10, FIG. 11, and FIG. 12, due to the use of MOS transistors, the energy needed for charging the storage unit 203 and with a higher voltage can be controlled by the control signal output by the logic control circuit 106 and with a lower voltage. The operating principle can be described detailedly as follows:

1. The PMOS transistor 707 is used to control the charging process. And, in the state of charging, in which the PMOS transistor 707 is on and the NMOS transistor 809 is cut off, the PMOS transistor 707 provides pull-up drive for the PMOS transistor 706 to render it into the state of cut-off.
2. In the state of non-charging, in which the PMOS transistor 707 is cut off and the NMOS transistor 809 is on, the NMOS transistor 809, on the one hand, ensures the output of the charging control circuit 1101 to be in a lower level, thereby ensuring the security of the electronic detonator 200 in the state of non-charging; on the other hand, provides pull-down drive for the PMOS transistor 706.
3. In the state of non-charging, the PMOS transistor 706 is conductive and the NMOS transistor 808 is cut off, which provides strong pull-up drive for the PMOS transistor 707 to reliably cut it off. In the state of charging, the PMOS transistor 706 is cut off, and as long as the NMOS transistor 808 is conductive, the PMOS transistor 707 will be in the state of conduction.
4. The resistor 307 is used to limit the current when the storage unit 203 is charged, in order to avoid impact on the electronic detonator network caused by excessive current in the process of charging.
5. The diode 406 is to limit reverse discharging of the storage unit 203 via the charging control circuit 1101, thereby enhancing energy utilization efficiency of the storage unit 203.
6. The PMOS transistor 705 and the NMOS transistor 807 constitute an inverter. The supply voltage of the inverter and the working voltage of the logic control circuit 106 are from the power supply management circuit 104, so a pair of control signals with the same amplitudes and opposite phases are gained because of the existence of the inverter. The signals respectively control the NMOS transistor 808 and the NMOS transistor 809 and render them in a state of conduction or cut-off, thus rendering the PMOS transistor 706 and the PMOS transistor 707 in a state of cut-off or conduction respectively, thereby achieving the control of lower voltage over a higher charging voltage.

Figure 13:
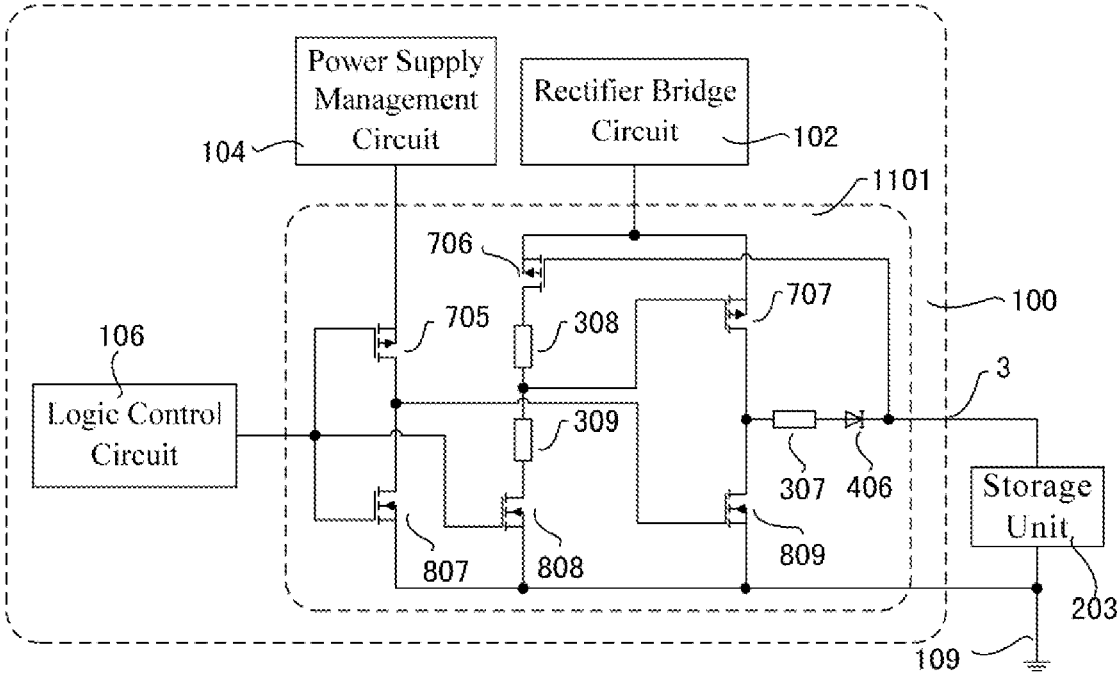
FIG. 13 is the fourth embodiment of the charging control circuit of the chip according to the invention when needing power supply.

As a fourth embodiment of the charging control circuit 1101, as shown in FIG. 13, the charging control circuit 1101 includes a PMOS transistor 705, a PMOS transistor 706, a PMOS transistor 707, an NMOS transistor 807, an NMOS transistor 808, an NMOS transistor 809, a resistor 307, a resistor 308, a resistor 309, and a diode 406. The detailed connection is described as follows:

The source and the substrate of the PMOS transistor 705 are connected to the power supply management circuit 104; the grid of the PMOS transistor 705, the grid of the NMOS transistor 807, and the grid of the NMOS transistor 808 are connected to the logic control circuit 106 together; the drain of the PMOS transistor 705, the drain of the NMOS transistor 807, and the grid of the NMOS transistor 809 connect together. The drain of the PMOS transistor 707 and the drain of the NMOS transistor 809 are connected to one end of the resistor 307, while the other end of the resistor 307 is connected to the anode of the diode 406. The source and the substrate of the PMOS transistor 706, and the source and the substrate of the PMOS transistor 707 are jointly connected to the rectifier bridge circuit 102; the drain of the PMOS transistor 706 is connected to one end of the resistor 308; the other end of the resistor 308 is connected to the grid of the PMOS transistor 707, and also connected to one end of the resistor 309; the other end of the resistor 309 is connected to the drain of the NMOS transistor 808; the grid of the PMOS transistor 706 and the cathode of the diode 406 are connected to the pin 3 within the chip 100. The source and the substrate of the NMOS transistor 807, the source and the substrate of the NMOS transistor 808, and the source and the substrate of the NMOS transistor 809 are grounded to the ground 109 together.

Figure 14:
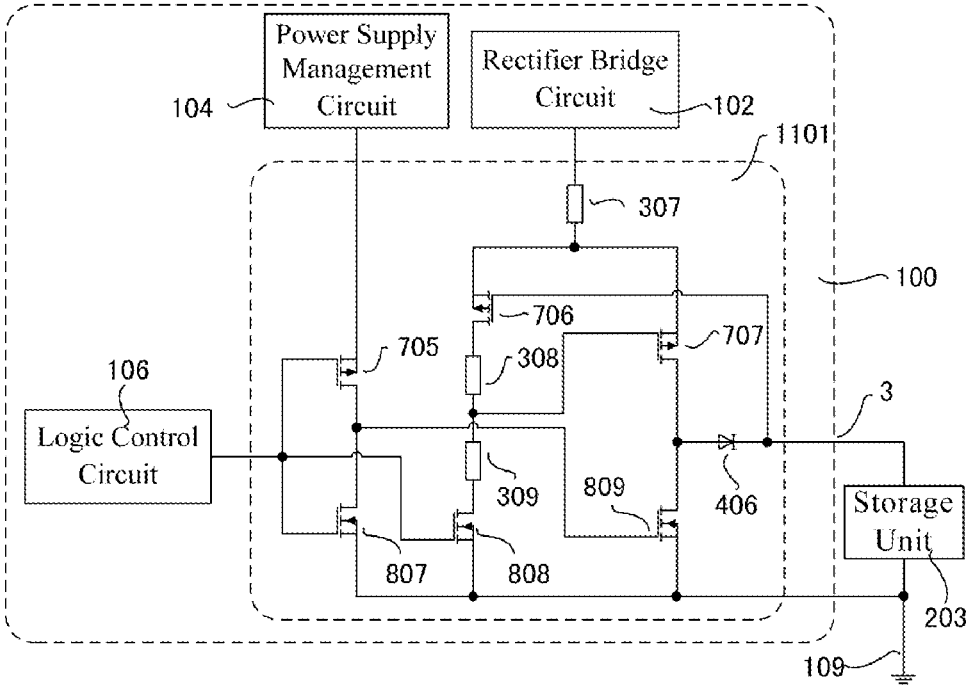
FIG. 14 is the fifth embodiment of the charging control circuit of the chip according to the invention when needing power supply.

As a fifth embodiment of the charging control circuit 1101, as shown in FIG. 14, the charging control circuit 1101 includes a PMOS transistor 705, a PMOS transistor 706, a PMOS transistor 707, an NMOS transistor 807, an NMOS transistor 808, an NMOS transistor 809, a resistor 307, a resistor 308, a resistor 309, and a diode 406. The detailed connection is described as follows:

The source and the substrate of the PMOS transistor 705 are connected to the power supply management circuit 104; the grid of the PMOS transistor 705, the grid of the NMOS transistor 807, and the grid of the NMOS transistor 808 are connected to the logic control circuit 106 together; the drain of the PMOS transistor 705, the drain of the NMOS transistor 807 and the grid of the NMOS transistor 809 connect together. The source and the substrate of the PMOS transistor 706, and the source and the substrate of the PMOS transistor 707 are connected to one end of the resistor 307, while the other end of the resistor 307 is connected to the rectifier bridge circuit 102; the drain of the PMOS transistor 706 is connected to one end of the resistor 308, while the other end of the resistor 308 is connected to the grid of the PMOS transistor 707 and also connected to one end of the resistor 309; the other end of the resistor 309 is connected to the drain of the NMOS transistor 808; the grid of the PMOS transistor 706 and the cathode of the diode 406 are connected to the pin 3 together. The drain of the PMOS transistor 707, the drain of the NMOS transistor 809, and the anode of the diode 406 connect together. The source and the substrate of the NMOS transistor 807, the source and the substrate of the NMOS transistor 808, and the source and the substrate of the NMOS transistor 809 are grounded to the ground 109.

Figure 15:
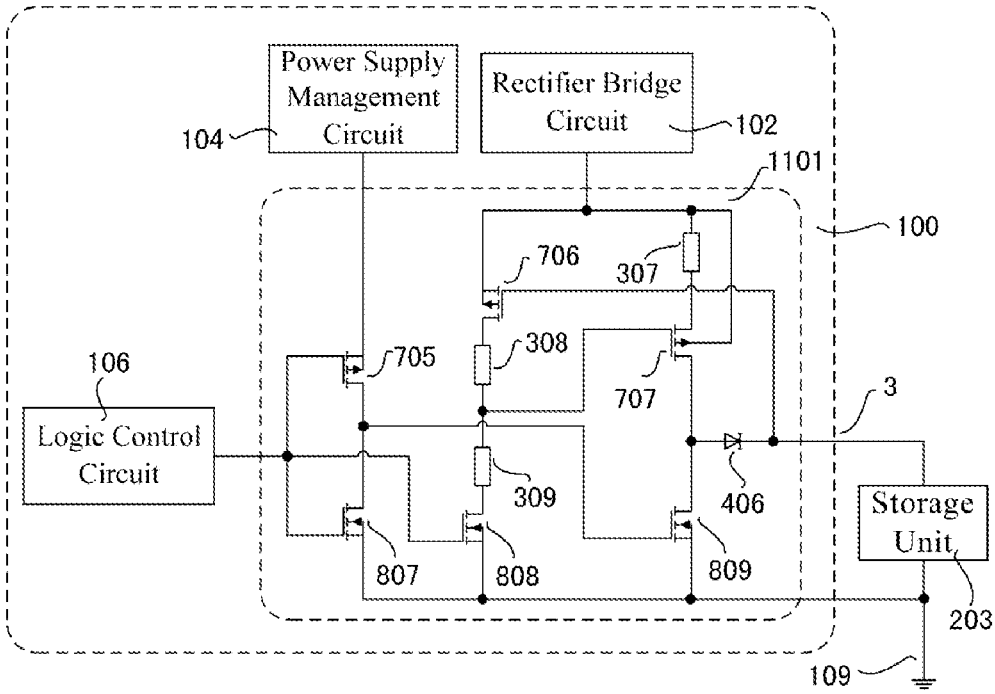
FIG. 15 is the sixth embodiment of the charging control circuit of the chip according to the invention when needing power supply.

As a sixth embodiment of the charging control circuit 1101, as shown in FIG. 15, the charging control circuit 1101 includes a PMOS transistor 705, a PMOS transistor 706, a PMOS transistor 707, an NMOS transistor 807, an NMOS transistor 808, an NMOS transistor 809, a resistor 307, a resistor 308, a resistor 309, and a diode 406. The detailed connection is described as follows:

The source and the substrate of the PMOS transistor 705 are connected to the power supply management circuit 104; the grid of the PMOS transistor 705, the grid of the NMOS transistor 807, and the grid of the NMOS transistor 808 are connected to the logic control circuit 106 together; the drain of the PMOS transistor 705, the drain of the NMOS transistor 807, and the grid of the NMOS transistor 809 connect together. The source and the substrate of the PMOS transistor 706, the substrate of the PMOS transistor 707, and one end of the resistor 307 are connected to the rectifier bridge circuit 102; the other end of the resistor 307 is connected to the source of the PMOS transistor 707; the grid of the PMOS transistor 706 and the cathode of the diode 406 are connected to the pin 3 together; the drain of the PMOS transistor 706 is connected to one end of the resistor 308, while the other end of the resistor 308 is connected to the grid of the PMOS transistor 707 and also connected to one end of the resistor 309; the other end of the resistor 309 is connected to the drain of the NMOS transistor 808. The drain of the PMOS transistor 707, the drain of the NMOS transistor 809, and the anode of the diode 406 connect together. The source and the substrate of the NMOS transistor 807, the source and the substrate of the NMOS transistor 808, and the source and the substrate of the NMOS transistor 809 are grounded to the ground 109 together.

The embodiments in FIG. 13-15 have basically the same basic principles as the embodiments in FIG. 10-12. The difference lies in that the control to the grid of the PMOS transistor 706 is from the voltage across the storage capacitor in the storage unit 203. Therefore, the equivalent resistance of the PMOS transistor 706 decreases with the voltage's rise. Meanwhile, a pair of voltage-division resistors, the resistor 308 and the resistor 309, are used to adjust the voltage of the PMOS transistor 707. Consequently, the equivalent resistance of the PMOS transistor 707 can be dynamically adjusted in the charging process, inversely proportional to the storage voltage, thereby increasing the stability of the charging current.

Figure 16:
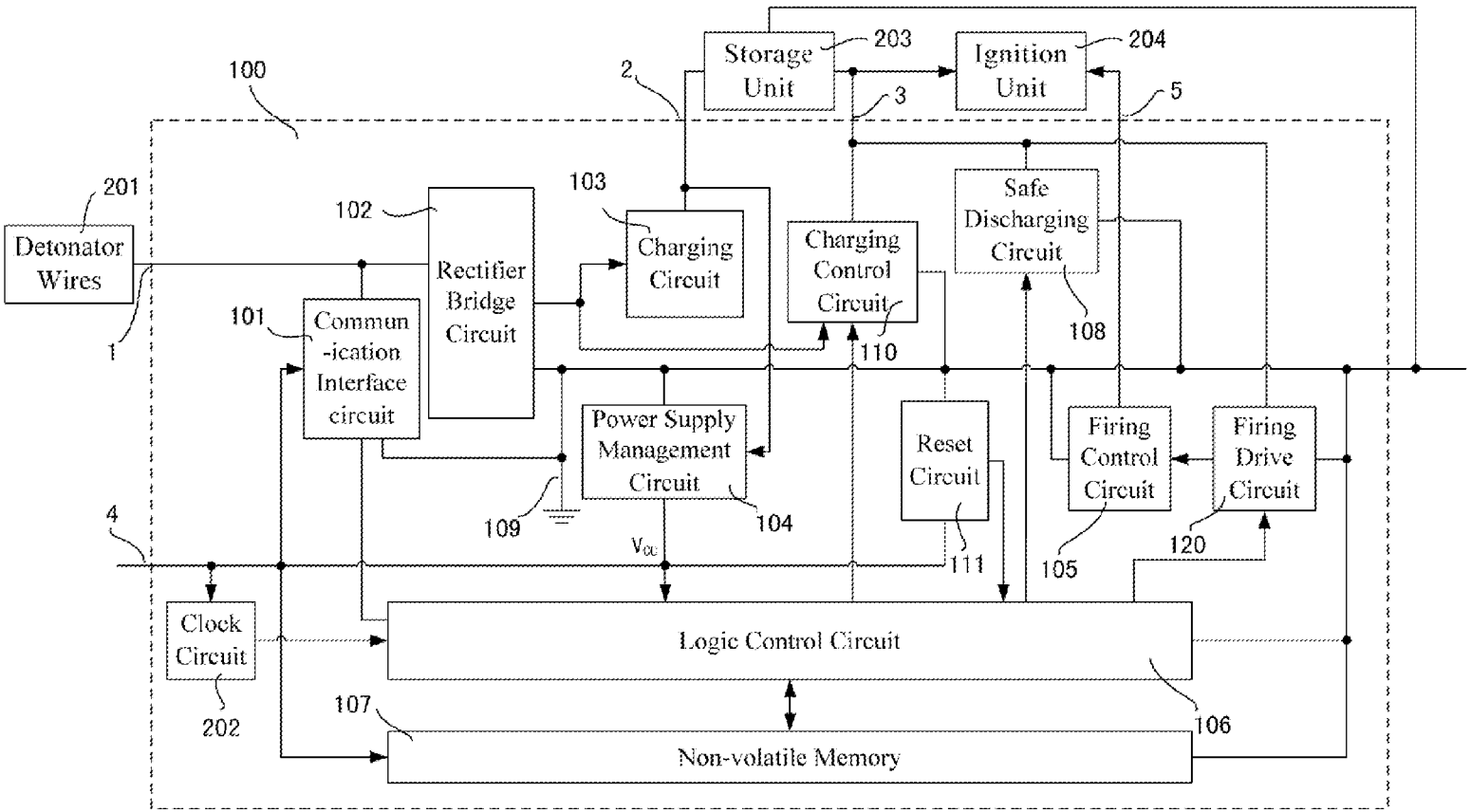
FIG. 16 is a logic diagram of the control chip according to the invention when the firing drive circuit not needing power supply.

As a seventh aspect of this invention, the chip 100 further includes a firing drive circuit 120. One end of the firing drive circuit 120 is grounded to the ground 109; one end is connected to the pin 3 and further connected to the positive pole of the external ignition capacitor, supplying high-voltage driving power to the firing drive circuit 120; the firing drive circuit 120 is connected in series between the logic control circuit 106 and the firing control circuit 105 via the other two ends of the firing drive circuit 120, as seen in FIG. 16. Thus, the firing drive circuit 120 receives a firing control signal of lower voltage output by the logic control circuit 106 and outputs a firing control signal of higher voltage to the firing control circuit 105.

Figure 17:
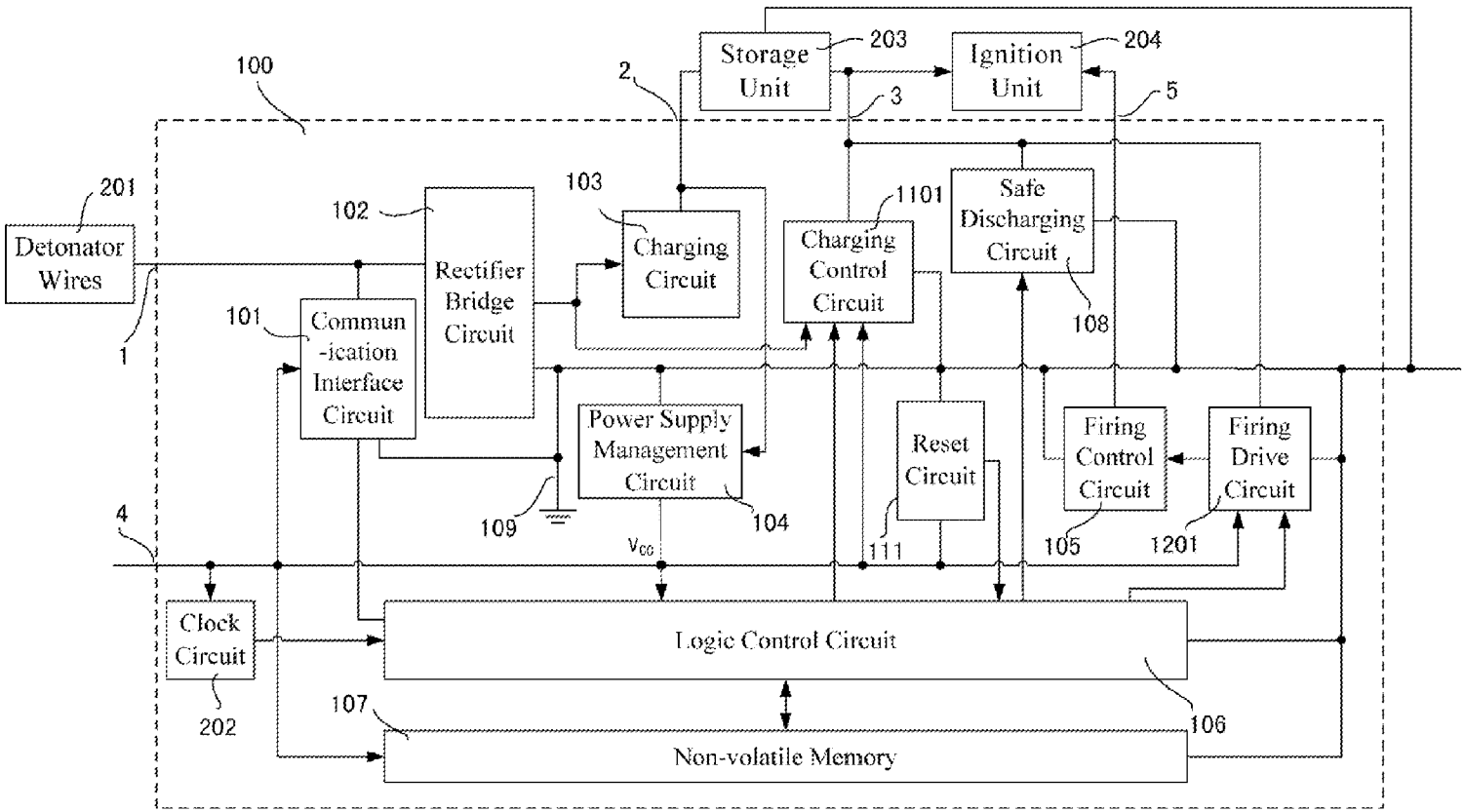
FIG. 17 is a logic diagram of the control chip according to the invention when the firing drive circuit needing power supply.

As another embodiment, one end of the firing drive circuit 1201 is grounded to the ground 109; one end is connected to the pin 3 and further connected to the positive pole of the ignition capacitor at the external of the chip 100, supplying high-voltage-driving power to the firing drive circuit 1201; one end is connected to the pin 4, to be powered by the power supply management circuit 104; the firing drive circuit 1201 is connected in series between the logic control circuit 106 and the firing control circuit 105 via the other two ends of the firing drive circuit 1201, as seen in FIG. 17. Thus, the firing drive circuit 1201 receives a firing control signal of lower voltage output by the logic control circuit 106 and outputs a firing control signal of higher voltage to the firing control circuit 105.

Figure 18:
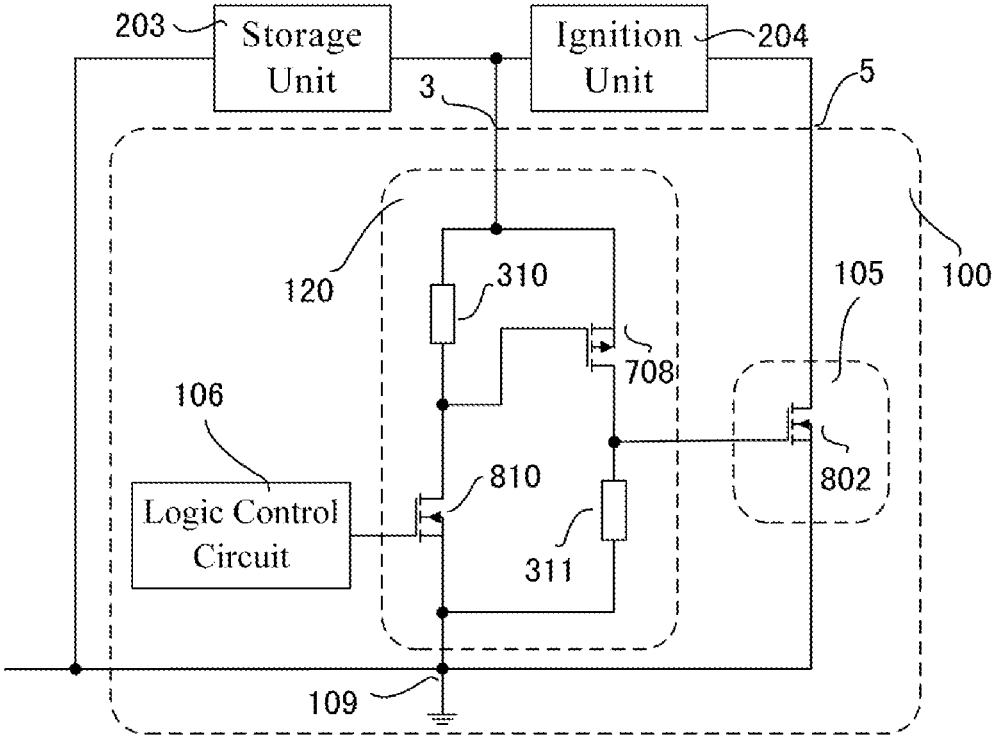
FIG. 18 is an embodiment of the firing drive circuit not needing power supply according to the invention.

As shown in FIG. 18, in the first embodiment of the firing drive circuit 120 that can work without power supply shown in FIG. 16, the firing drive circuit 120 includes a PMOS transistor 708, an NMOS transistor 810, a resistor 310, and a resistor 311, wherein, the source and the substrate of the PMOS transistor 708 and one end of the resistor 310 connect together, and are connected to the pin 3 together; the grid of the PMOS transistor 708, the other end of the resistor 310, and the drain of the NMOS transistor 810 connect together; the drain of the PMOS transistor 708 and one end of the resistor 311 connect together, with both connected to the grid of the NMOS transistor 802; the other end of the resistor 311 is grounded to the ground 109; the source and the substrate of the NMOS transistor 810 are grounded to the ground 109, its grid is connected to the logic control circuit 106. Resistance of the resistor 310 and the resistor 311 is preferred not less than 100 KΩ.

The operating principle of the embodiment of the firing drive circuit 120 shown in FIG. 18 is as follows: when applied on the grid the logic high level signal of lower voltage output by the logic control circuit 106, the NMOS transistor 810 is conductive, and therefore the grid level of the PMOS transistor 708 is pulled down, thereby switching on the PMOS transistor 708. As the conduction resistance of the PMOS transistor 708 is very low, the voltage of the control signal to the firing control circuit 105 output by the firing drive circuit 120 is the same as the voltage of the pin 3.

Figure 19:
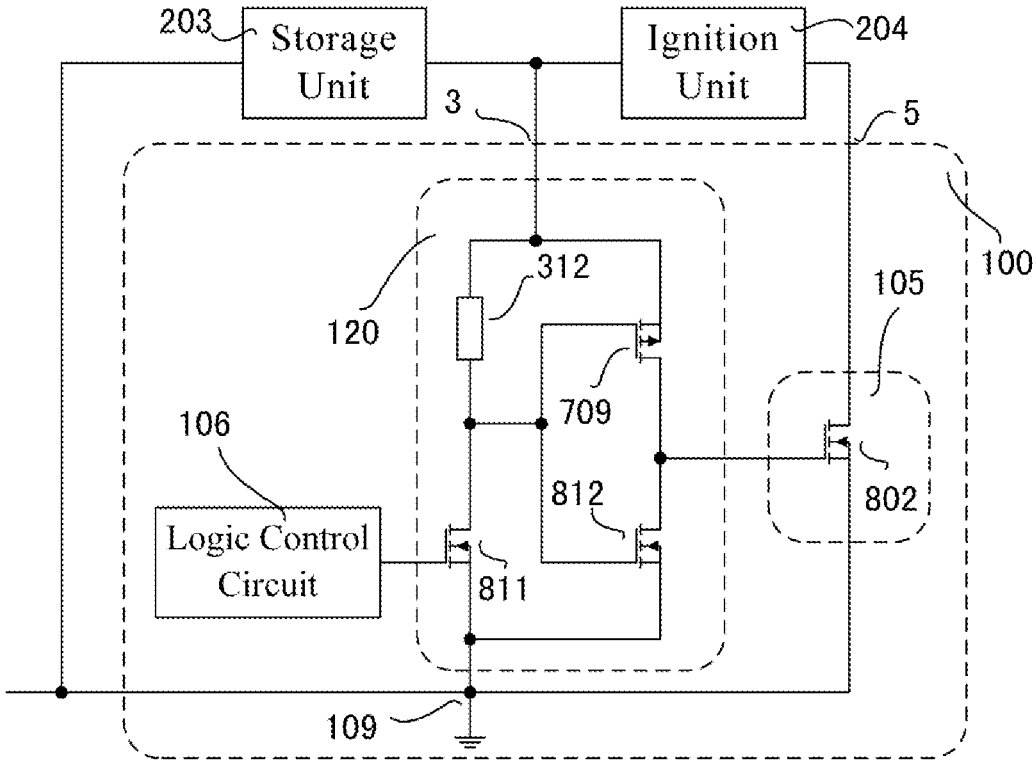
FIG. 19 is another embodiment of the firing drive circuit not needing power supply according to the invention.

As shown in FIG. 19, in the second embodiment of the firing drive circuit 120 that can work without power supply shown in FIG. 16, the firing drive circuit 120 includes a PMOS transistor 709, a resistor 312, an NMOS transistor 811, and an NMOS transistor 812, wherein, the source and the substrate of the PMOS transistor 709 and one end of the resistor 312 connect together, and are connected to the pin 3 together; the other end of the resistor 312, the grid of the PMOS transistor 709, the drain of the NMOS transistor 811, and the grid of the NMOS transistor 812 connect together; the drain of the PMOS transistor 709 and the drain of the NMOS transistor 812 connect together, and are jointly connected to the grid of the NMOS transistor 802; the source and the substrate of the NMOS transistor 811, and the source and the substrate of the NMOS transistor 812 are grounded to the ground 109; the grid of the NMOS transistor 811 is connected to the logic control circuit 106. The resistance of the resistor 312 is preferred not less than 100 KΩ.

The operating principle of the embodiment shown in FIG. 19 is as follows: when the output of the logic control circuit 106 is at low level, the NMOS transistor 811 will be cut off, with the resistor 312 slightly pulling up the grids of the PMOS transistor 709 and the NMOS transistor 812, thus rendering the PMOS transistor 709 in "off" state and the NMOS transistor 812 in "on" state, and therefore rendering the control signal of the firing control circuit 105 in a state of strong pull-down. When the output of the logic control circuit 106 is at high level, the NMOS transistor 811 will be on, strongly pulling down the grid of the PMOS transistor 709 and the grid of the NMOS transistor 812, rendering the PMOS transistor 709 in "on" state and the NMOS transistor 812 cut off, and therefore rendering the voltage of the control signal to the firing control circuit 105 output by the firing drive circuit 120 equal to the voltage of the pin 3.

Figure 20:
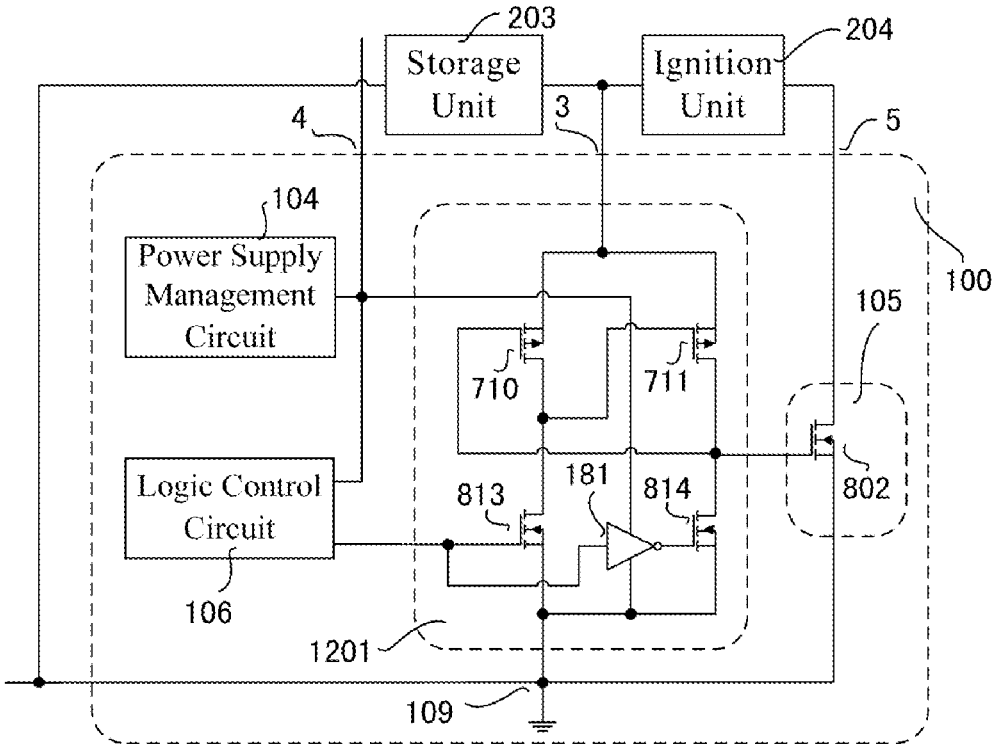
FIG. 20 is an embodiment of the firing drive circuit with power supply according to the invention.

FIG. 20 shows the first embodiment of the firing drive circuit 1201 in FIG. 17, which cannot work without power supply. The firing drive circuit 1201 includes an inverter 181, a PMOS transistor 710, a PMOS transistor 711, an NMOS transistor 813, and an NMOS transistor 814, wherein, the source and the substrate of the PMOS transistor 710, and the source and the substrate of the PMOS transistor 711 connect together, and are jointly connected to the pin 3; the drain of the PMOS transistor 710, the grid of the PMOS transistor 711, and the drain of the NMOS transistor 813 connect together; the grid of the PMOS transistor 710, the drain of the PMOS transistor 711, and the drain of the NMOS transistor 814 connect together, and are jointly connected to the grid of the NMOS transistor 802. The source and the substrate of the NMOS transistor 813, and the source and the substrate of the NMOS transistor 814 are grounded to the ground 109; the grid of the NMOS transistor 813 and the input terminal of the inverter 181 connect together, with both connected to the logic control circuit 106; the grid of the NMOS transistor 814 is connected to the output terminal of the inverter 181. The power supply input terminal of the inverter 181 is connected to the pin 4, powered by the power supply management circuit 104; the other end of the inverter 181 is grounded to the ground 109.

The operating principle of the embodiment shown in FIG. 20 is as follows: when the output of the logic control circuit 106 is at low level, the NMOS transistor 813 will be cut off, and the logic level to the NMOS transistor 814 output by the inverter 181 will be at high level and the NMOS transistor 814 will be on, rendering the control signal input terminal of the firing control circuit 105 and the grid of the PMOS transistor 710 in a state of strong pull-down, the PMOS transistor 710 in a state of conduction, and the gird and the source of the PMOS transistor 711 in a state of short-circuit, thus the PMOS transistor 711 will be in a state of cut-off. When the output of the logic control circuit 106 is at high level, the NMOS transistor 813 will be on, with the grid of the PMOS transistor 711 at low level and the PMOS transistor 711 on; meanwhile, the logic level to the NMOS transistor 814 output by the inverter 181 is low, then the NMOS transistor 814 will be cut off, thus the control signal input terminal of the firing control circuit 105, the grid of the PMOS transistor 710 and the pin 3 will have the same voltage, with the PMOS transistor 710 in a state of cut-off.

Figure 21:
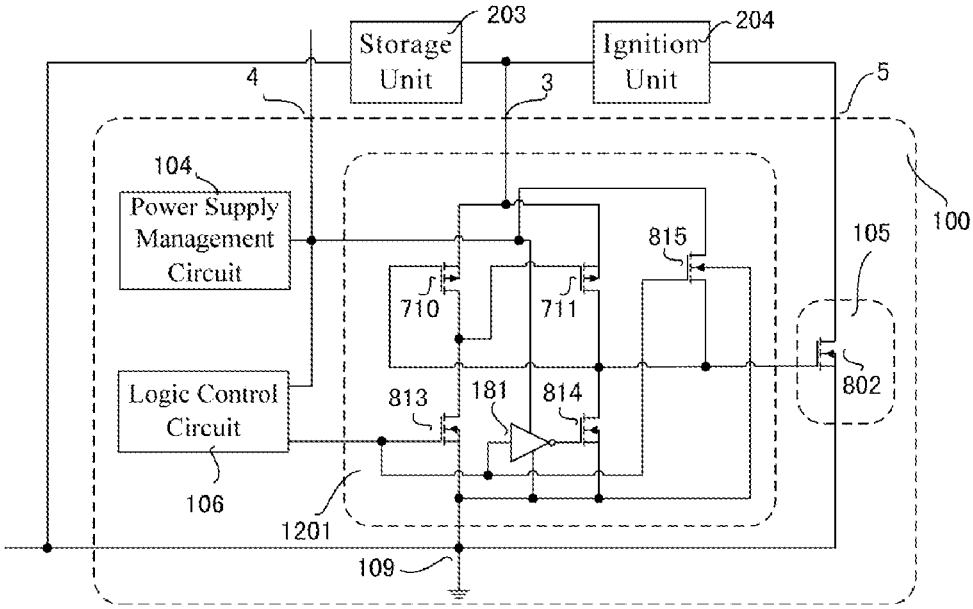
FIG. 21 is another embodiment of the firing drive circuit needing power supply according to the invention.

FIG. 21 shows the second embodiment of the firing drive circuit 1201 in FIG. 17, which cannot work without power supply. On the basis of the first embodiment, the firing drive circuit 1201 further includes an NMOS transistor 815. The drain of the NMOS transistor 815 and the power supply input terminal of the inverter 181 connect together, with both connected to the pin 4 and powered by the power supply management circuit 104; the source of the NMOS transistor 815, the grid of the PMOS transistor 710, the drain of the PMOS transistor 711, and the drain of the NMOS transistor 814 connect together, and are jointly connected to the grid of the NMOS transistor 802; the grid of the NMOS transistor 815, the grid of the NMOS transistor 813, and the input terminal of the inverter 181 connect together, and are jointly connected to the logic control circuit 106; the substrate of the NMOS transistor 815 is grounded to the ground 109.

The operating principle of the embodiment shown in FIG. 21 is as follows: When the output of the logic control circuit 106 is at high level, the firing control circuit 105 will be in the ignition state. At the initial stage of ignition, the voltage of the pin 3 is higher than that of the pin 4, and the NMOS transistor 815 is in "off" state. When the voltage of the pin 3 gradually reduces, with the discharging of the ignition capacitor, to a value around the threshold voltage of the PMOS transistor 711, the conduction resistance of the PMOS transistor 711 will become greater, and the voltage of the source of the NMOS transistor 815 will also reduce to a value around the threshold voltage at the same time, then the NMOS transistor 815 will be on, so as to continue to drive the control signal of the firing control circuit 105 using the power supply management circuit 104.

Figure 26:
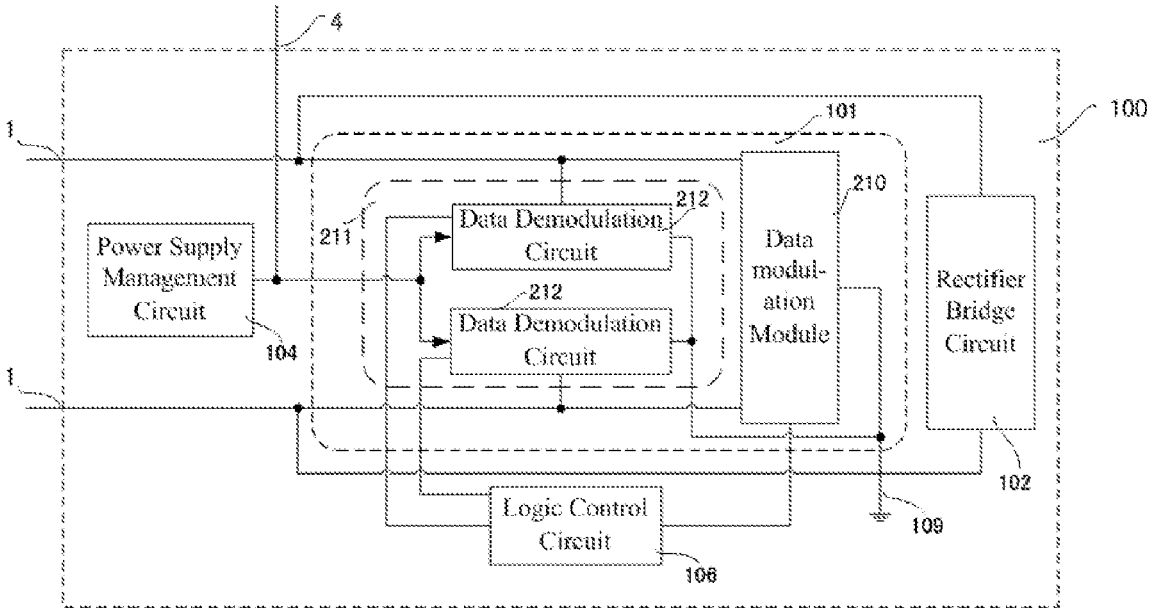
FIG. 26 is a logic diagram of the communication interface circuit of the chip according to the invention.

As the eighth aspect of this invention, the communication interface circuit 101 of the invention further includes a data modulation module 210 and a data demodulation module 211, wherein, the data demodulation module 211 is composed of two data demodulation circuits 212, as shown in FIG. 26. The connections are as follows:

(1) The two data demodulation circuits 212 are connected to pins 1 respectively, and sample the information of the voltage change of the signal bus 300 via the detonator wires 201. The two data demodulation circuits 212 are also connected to the logic control circuit 106 respectively to send the information sampled from the signal bus 300 to the logic control circuit 106 for processing. The two data demodulation circuits 212 are also connected to the pin 4 together to be supplied by the power supply management circuit 104, so that the signal level output to the logic control circuit 106 is basically the same as the operating voltage of the logic control circuit 106. The two data demodulation circuits 212 are also grounded to the ground 109.

(2) One end of the data modulation module 210 is connected to the logic control circuit 106, one end is grounded to the ground 109, and the other two ends are connected to pins 1 respectively. The data modulation module 210 is used to transform the data information sent out by the logic control circuit 106 and in the form of high and low level into the changes of current consumption of the electronic detonator, and upload it onto the single bus 300 via the detonator wires 201, to send to the detonation apparatus 400 ultimately.

Figure 27:
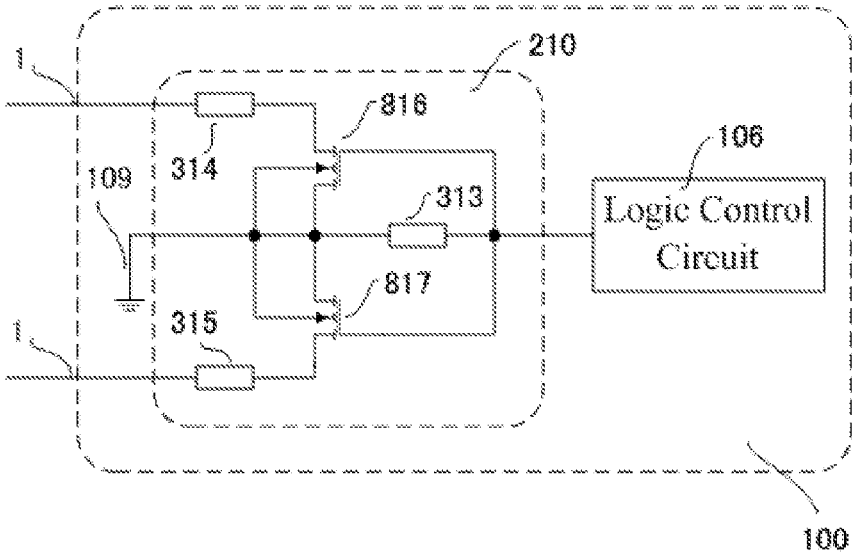
FIG. 27 is an embodiment of the data modulation module of the chip according to the invention.

The data modulation module 210 can further include a resistor 313, a resistor 314, a resistor 315, an NMOS transistor 816, and an NMOS transistor 817, as illustrated in FIG. 27. The resistor 313 provides pull-down drive for the grid of the NMOS transistor 816 and the NMOS transistor 817, and the resistor 314 and the resistor 315 are used to realize the information transformation from voltage changes into current consumption changes. The drain and the substrate of the NMOS transistor 816, the drain and the substrate of the NMOS transistor 817, and one end of the resistor 313 are grounded to the ground 109; the grid of the NMOS transistor 816 and the grid of the NMOS transistor 817 are connected to the other end of the resistor 313, and further connected to the logic control circuit 106. The source of the NMOS transistor 816 is connected to one of the two pins 1 via the resistor 314, and further connected to one of the detonator wires 201; the source of the NMOS transistor 817 is connected to the other pin 1 via the resistor 315, and further connected to the other detonator wire 201.

The data modulation module 210 can upload the data to be sent onto the detonator wires 201 in the form of changes in current consumption, and its operating principle is as follows:

(1) When sending data "1", the logic control circuit 106 outputs a control signal at high level, then the grid voltage of the NMOS transistor 816 and the NMOS transistor 817 is high, and the NMOS transistor 816 and the NMOS transistor 817 will be on. At this moment, the current of the signal bus 300 caused by the electronic detonator is the bus voltage divided by the sum of the resistances of the resistor 314 and the resistor 315, in milliampere level, much higher than the normal operating current of the electronic detonator 200 which is in microampere level.

(2) When sending data "0", the logic control circuit 106 outputs a control signal at low level, the grid voltage of the NMOS transistor 816 and the NMOS transistor 817 is low, and the NMOS transistor 816 and the NMOS transistor 817 will be cut off, then the current of the signal bus 300 caused by the electronic detonator equals the normal operating current of the electronic detonator 200.

Figure 28:
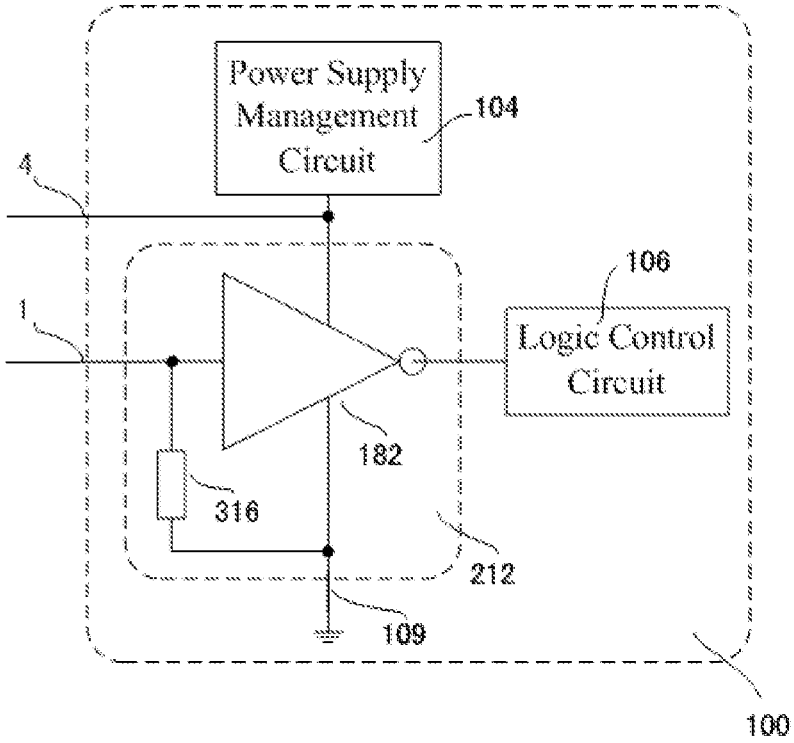
FIG. 28 is an embodiment of the data demodulation circuit of the chip according to the invention.

The data demodulation circuit 212 may further include an inverter 182 and a resistor 316 as shown in FIG. 28. The inverter 182 is used to extract the data information from the signal bus 300 and transmit it into the chip 100 via the detonator wires 201. One end of the inverter 182 is connected to the pin 4, one end is grounded to the ground 109; the input terminal of the inverter 182 is connected to one of the detonator wires 201, and is grounded to the ground 109 via the resistor 316. The resistor 316 is used to provide pull-down drive for input of the inverter 182, which, on the one hand, prevents the input of the inverter 182 from being in an indefinite state when the signal bus 300 is disconnected accidentally, on the other hand, provides a discharging channel for the residual charge of the bus 300 to improve the communication speed when changes of the data of the bus 300 take place. The output terminal of the inverter 182 is connected to the logic control circuit 106.

Figure 29:
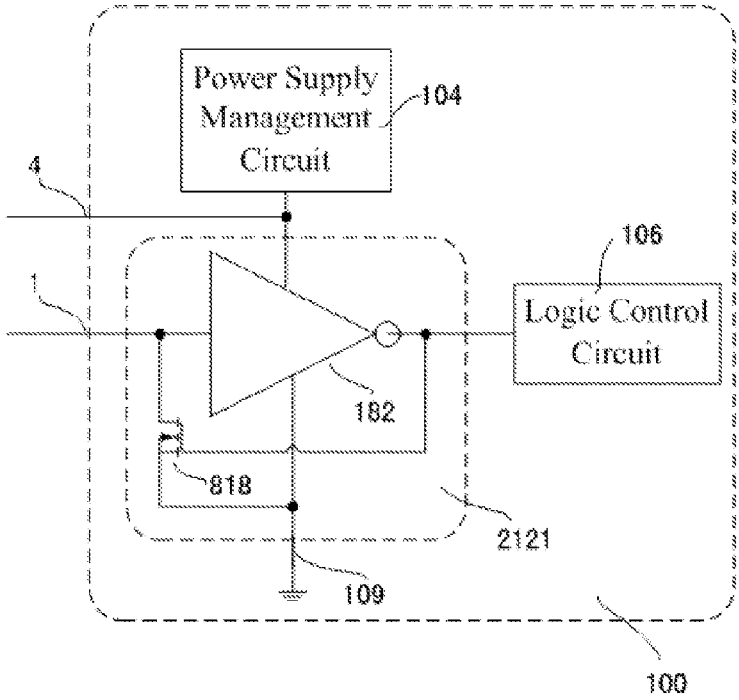
FIG. 29 is another embodiment of the data demodulation circuit of the chip according to the invention.

Alternatively, the data demodulation circuit 2121 may further include an inverter 182 and an NMOS transistor 818, as illustrated in FIG. 29. One end of the inverter 182 is connected to the pin 4, one end is grounded to the ground 109, and the other two ends work as the input terminal and the output terminal respectively. The source and the substrate of the NMOS transistor 818 are grounded to the ground 109 to provide degenerative feedback to the input terminal of the inverter 182; its drain is connected to the input terminal of the inverter 182, and they are connected to one of the detonator wires 201 together; the grid of the NMOS transistor 818 is connected to the output terminal of the inverter 182, and they are connected to the logic control circuit 106 together. When the voltage of the bus 300 is high, the output of the inverter 182 is low and the NMOS transistor 818 is off. When the voltage of the bus 300 varies from high to low, the output voltage of the inverter 182 varies from low to high accordingly, so does the grid voltage of the NMOS transistor 818. During the time, the NMOS transistor 818 enters the saturation-on region from the cut-off region and through the variable resistance region, and gradually releases the residual charge of the bus 300. While the bus 300 is disconnected by accident, the input of the inverter 182 may be in a definite state of low level due to the existence of the NMOS transistor 818.

Schmitt inverter is preferable as the inverter 182 in the embodiments shown in FIG. 28 and FIG. 29, so that the output edge of the inverter is steep and the transition time for level switching is extremely short, whether state switching of the signal input to the inverter is slow or not, or whether the transition time for level switching is long or not. It shortens the state-transition time of the processing circuits subsequent to the data demodulation circuit 212 and reduces the power consumption of the electronic detonator. In addition, Schmitt inverter has good anti-noise performance, which can improve the stability of the electronic detonator when receiving data.

Figure 22:
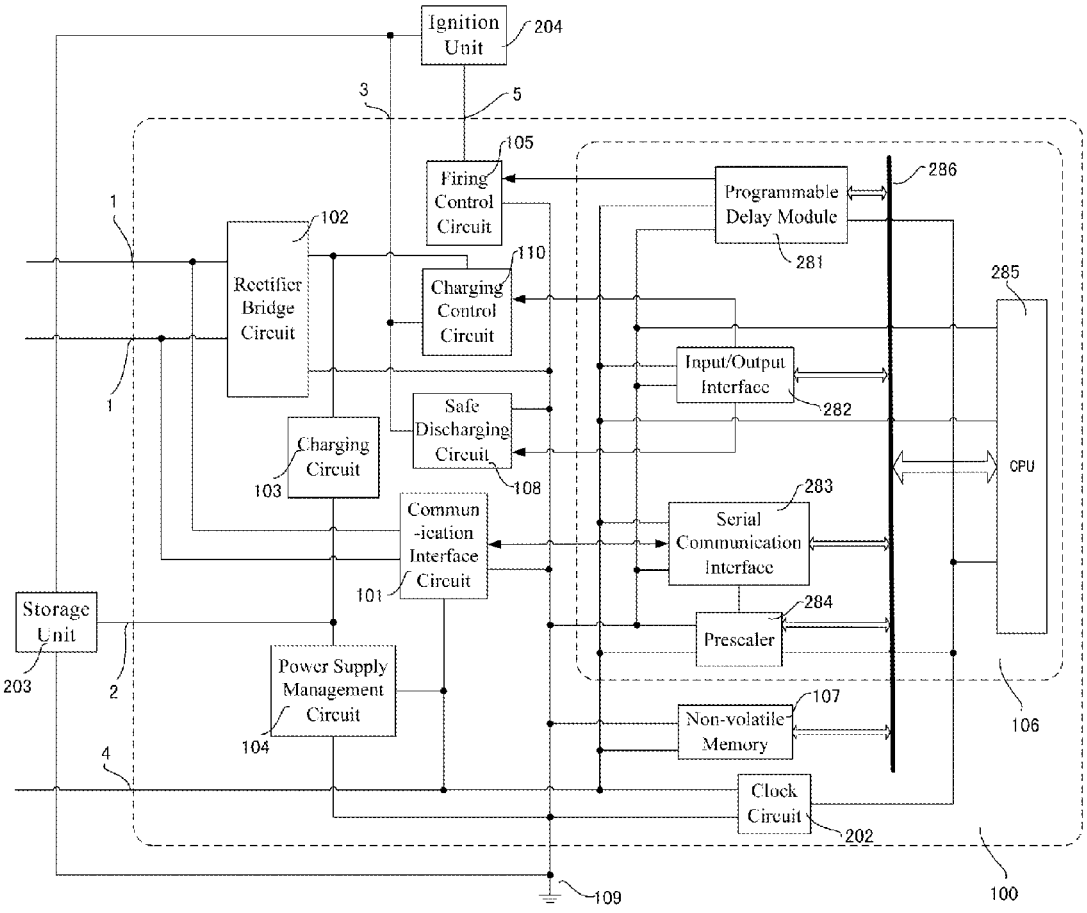
FIG. 22 is a logic diagram of the logic control circuit of the chip according to the invention.

As the ninth aspect of this invention, the logic control circuit 106 includes a programmable delay module 281, an input/output interface 282, a serial communication interface 283, a prescaler 284, and a CPU 285, as illustrated in FIG. 22. The programmable delay module 281 is preferably a presettable down-counter. The detailed connection is described as follows:

1. One end of the CPU 285 is connected to the pin 4, through which the CPU 285 is powered by the power supply management circuit 104; one end is grounded to the ground 109; one end is connected to the programmable delay module 281, the prescaler 284 and the clock circuit 202 which provides clock signals. The other end of the CPU 285 is connected to the programmable delay module 281, the input/output interface 282, the serial communication interface 283, and the prescaler 284 via the internal bus 286; the CPU 285 sets parameters or states for the four modules above via this end, and controls their operation.
2. One end of the programmable delay module 281 is connected to the firing control circuit 105, one end is connected to the pin 4, one end is grounded to the ground 109, one end is connected to the internal bus 286; and the other end of the programmable delay module 281 is connected to the CPU 285 and the prescaler 284, and they jointly connect to the clock circuit 202. The programmable delay module 281 is used to realize the programmability of the delay time of the electronic detonator so as to solve the unicity problem of detonator products. The programmable delay module 281 is powered by the power supply management circuitry 104, with its working clock (namely delay clock) provided by the clock circuit 202, and the delay-time data written into the module 281 by the CPU 285 via the data bus of the internal bus 286. The CPU 285 can control the programmable delay module 281 via the control bus of the internal bus 286, including control of its initial state, start, stop and so on. When the programmable delay module 281 counts to the delay time, it will output a signal to the firing control circuit 105 to render it in the ignition state, thus realizing the ignition.
3. One end of the input/output interface 282 is connected to the charging control circuit 110, one end is connected to the safe discharging circuit 108, one end is connected to the pin 4, one end is grounded to the ground 109, and the other end is connected to the internal bus 286. The input/output interface 282 is powered by the power supply management circuit 104, the state signal output to the charging control circuit 110 and the safe discharging circuit 108 is written in by the CPU 285 via the control bus of the internal bus 286, and the state signal input by the charging control circuit 110 and the safe discharging circuit 108 is read by the CPU 285 via the control bus of the internal bus 286.
4. One end of the serial communication interface 283 is connected to the communication interface circuit 101, one end is connected to the pin 4, one end is grounded to the ground 109, one end is connected to the prescaler 284, and the other end is connected to the internal bus 286. The serial communication interface 283, powered by the power supply management circuit 104, receives the data information sent by the external detonation apparatus 400. The serial communication interface 283 exchanges data with the external detonation apparatus 400 via the communication interface circuit 101, and exchanges data with the CPU 285 via the internal bus 286.

5. One end of the prescaler 284 is connected to the pin 4, one end is grounded to the ground 109, one end is connected to the serial communication interface 283, one end is connected to the internal bus 286; and the other end is connected to the CPU 285, the programmable delay module 281 and the clock circuit 202. The prescaler 284 provides the serial communication interface 283 with working clock and phase for receiving/sending data, and controls the communication baud rate and sampling phase of the serial communication interface 283. The prescaler 284 is powered by the power supply management circuit 104, and its working clock is provided by the clock circuit 202. The data to set the communication baud rate is written in by the CPU 285 via the data bus of the internal bus 286, and the sampling phase is controlled by the CPU 285 via the control bus of the internal bus 286.

The programmable delay module 281 of the electronic detonator control chip 100 in the present invention is preferably a presettable down-counter.

Figure 23:
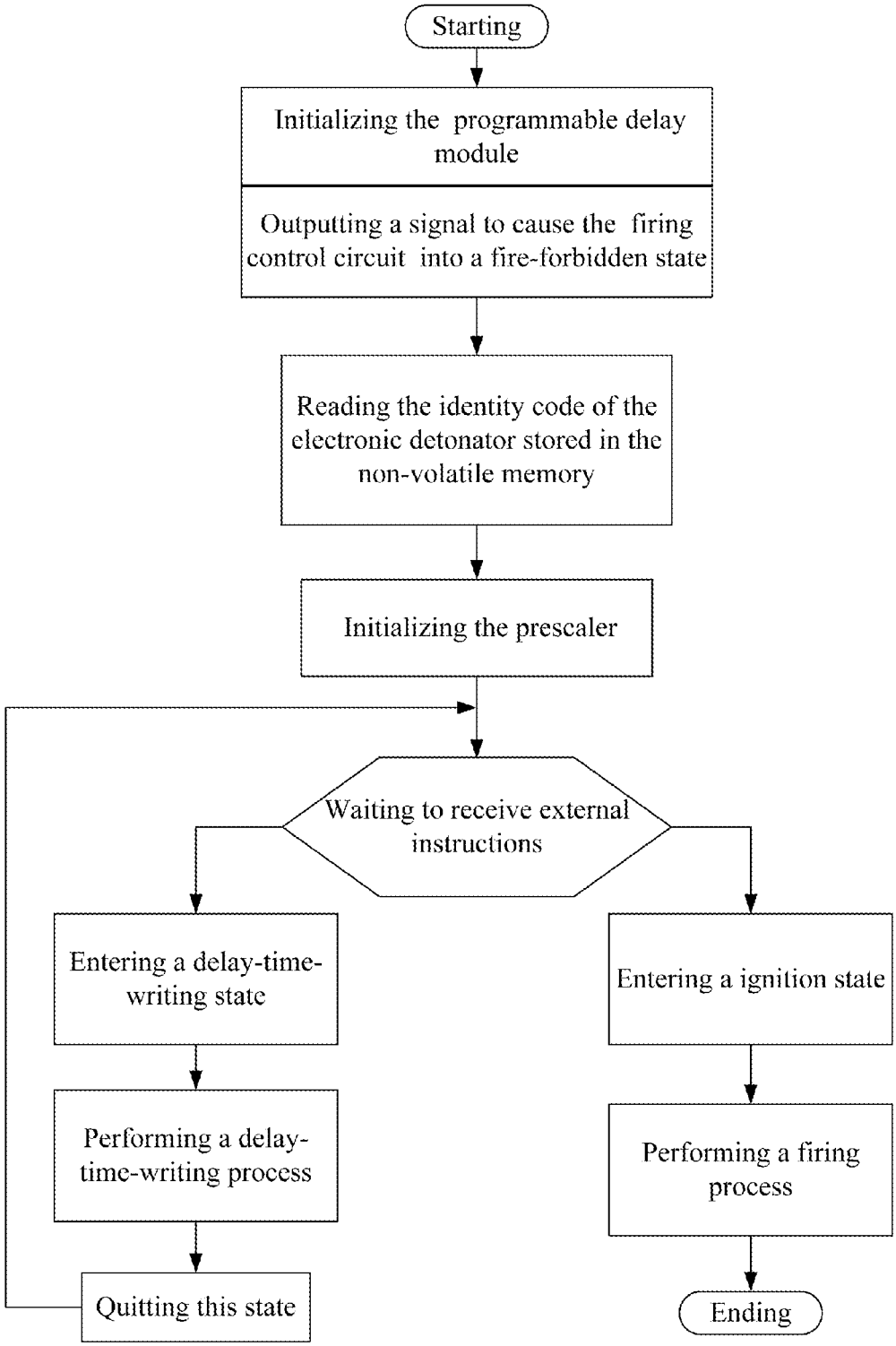
FIG. 23 is a control flow chart of the chip according to the invention.

The invention also provides a control flow of the electronic detonator control chip 100, as shown in FIG. 23, including the following steps:

Step 1, initialize the programmable delay module 281, that is, the CPU 285 sends a control signal to the programmable delay module 281 via an internal bus 286, causing it to output a signal which cuts off the firing control circuit 105, into a fire-forbidden state;

Step 2, the CPU 285 reads the identity code of the electronic detonator stored in the non-volatile memory 107;

Step 3, initialize the prescaler 284, that is, the CPU 285 writes the default number of clocks of the clock circuit 202 into the prescaler 284 to control the communication baud rate and the sampling phase of the serial communication interface 283;

Step 4, the CPU 285 waits to receive instructions from an apparatus 400 outside the electronic detonator: upon receiving an instruction to write the delay-time, perform step 5; upon receiving a firing instruction, perform step 6;

Step 5, perform a delay-time-writing process; and then go back to the step 4;

Step 6, perform a firing process; and then end the control process.

Figure 24:
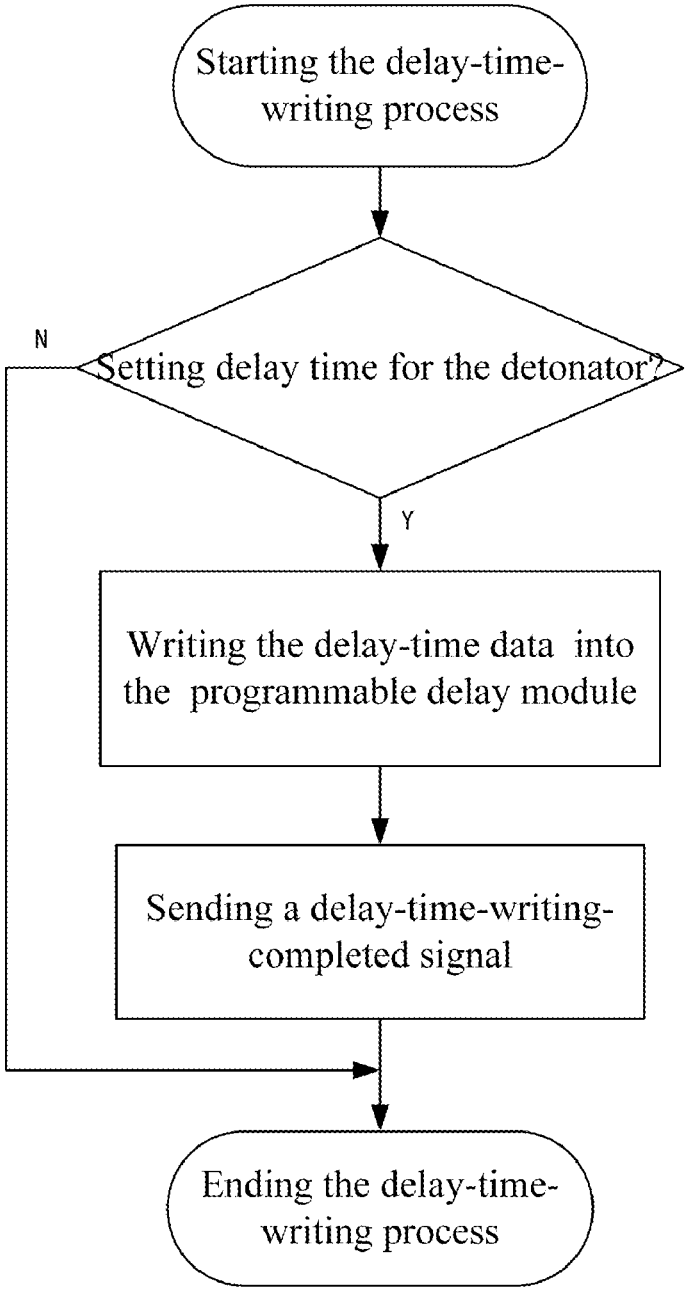
FIG. 24 is a flow chart of the delay-time-writing process of the chip according to the invention.

As illustrated in FIG. 24, the delay-time-writing process is carried out as follows:

Step one, the CPU 285 of a particular detonator judges whether or not to set a delay time for this particular detonator according to the identity code included in the delay-time-writing instruction: if the judgment is positive, perform step two; and if the judgment is negative, end the delay-time-writing process;

Step two, the CPU 285 writes the delay-time data included in the delay-time-writing instruction into the programmable delay module 281;

Step three, the electronic detonator sends a delay-time-writing-completed signal to the external apparatus; and then ends this delay-time-writing process.

Figure 25:
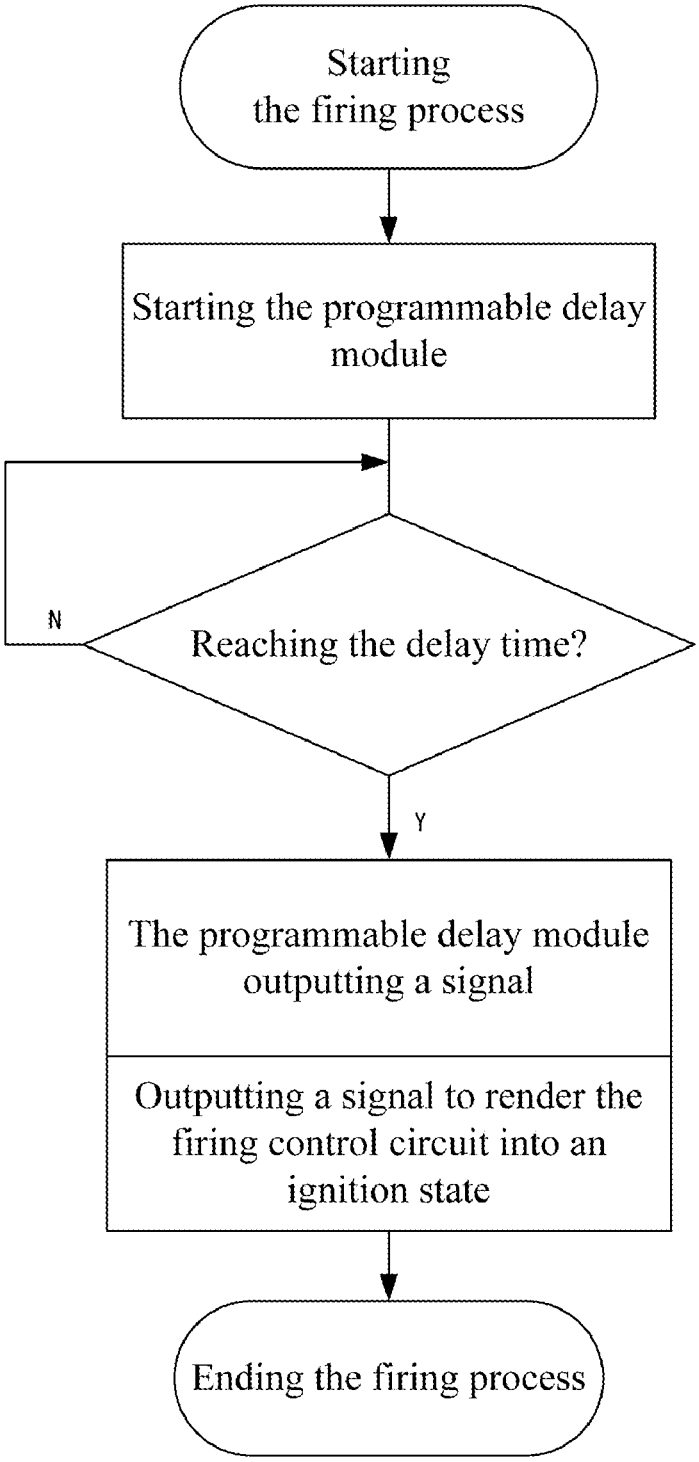
FIG. 25 is a flow chart of the firing process of the chip according to the invention.

As illustrated in FIG. 25, the firing process is carried out as follows:

step A, the CPU 285 sends the control signal to the programmable delay module 281 to start it;

step B, the CPU 285 waits for the end of the delay time, if the delay time reaches the end, perform step C; if not, continue to wait;

step C, the programmable delay module 281 outputs the signal to the firing control circuit 105, to switch it on, rendering it into an ignition state; end the firing process.

The electronic detonator detonation system controls the operation states of the electronic detonator by means of communication instructions. The electronic detonator works under the control of instructions sent by the external detonation apparatus 400 according to the control processes described above: the CPU 285 in the electronic detonator control chip 100 receives a delay-time-writing instruction via the communication interface circuit 101 and the serial communication interface 283, which realizes online programmability of detonator's delay time; the CPU 285 receives the firing instruction, which realizes the control of the programmable delay module 281, thus realizing the control of ignition process of the electronic detonator.

INDUSTRIAL PRACTICALITY

The electronic detonator control chip described above is a core component in the circuit board of an electronic detonator controller to control a detonation process. The control chip can eliminate many defects of ordinary detonators by means of two-wire non-polarity connection, bidirectional communication with an external detonation apparatus, built-in identity code, controllability of the detonation process, and online programmability of the delay time. The product according to the present invention can be manufactured in an industrial scale, with good industrial practicality and technical advantages. In addition, the product can be utilized in a convenient and safe way.

The invention claimed is:

1. An electronic detonator control chip, characterized by comprising a communication interface circuit, a rectifier bridge circuit, a charging circuit, a charging control circuit, a power supply management circuit, a firing control circuit, a logic control circuit, a non-volatile memory, a reset circuit, a safe discharging circuit, and a clock circuit, wherein one end of the rectifier bridge circuit is connected to the communication interface circuit, forming a set of first pin extending to the exterior of the chip; one end of the rectifier bridge circuit leads to the charging circuit and the charging control circuit, supplying power to the charging circuit and the charging control circuit; the other end of the rectifier bridge circuit is grounded;

one end of the charging circuit is connected to the rectifier bridge circuit; the other end is connected to the power supply management circuit and also extends to the exterior of the chip, forming a set of second pin;

one end of the charging control circuit is connected to the rectifier bridge circuit, one end is grounded, and one end is connected to the logic control circuit; another end of the charging control circuit is connected to the safe discharging circuit and also extends to the exterior of the control chip, forming a set of third pin;

one end of the safe discharging circuit is connected to the logic control circuit, one end is grounded, and the other end is connected to the third pin within the control chip;

one end of the power supply management circuit is connected to the second pin within the control chip, and one end is grounded; the other end of the power supply management circuit extends to the exterior of the chip, forming a set of fourth pin of the power supply output terminal of the control chip;

one end of the communication interface circuit is grounded, one end is connected to the first pin within the control chip, one end leads to the logic control circuit, and the other end is connected to the fourth pin within the control chip;

one end of the reset circuit is grounded, one end is connected to the fourth pin within the control chip, and the other end is connected to the logic control circuit;

one end of the firing control circuit is grounded; one end extends to the exterior of the control chip, forming a set of fifth pin, and the other end leads to the logic control circuit;

one end of the clock circuit is connected to the fourth pin within the chip, and the other end leads to the logic control circuit;

one end of the logic control circuit is connected to the clock circuit, one end is connected to the fourth pin within the control chip, one end is grounded, one end is connected to the non-volatile memory, one end is connected to the communication interface circuit, one end is connected to the reset circuit, one end is connected to the safe discharging circuit, one end is connected to the charging control circuit, and the other end is connected to the firing control circuit; and one end of the non-volatile memory is connected to the fourth pin within the control chip, one end is connected to the logic control circuit, and the other end is grounded;

wherein the safe discharging circuit includes a second resistor and a first NMOS transistor; the source and the substrate of the first NMOS transistor are grounded, its drain is connected to the third pin via the second resistor, and its grid is connected to the logic control circuit.

2. The electronic detonator control chip according to claim 1, characterized in that the charging circuit includes a first resistor and a first diode in series; the cathode of the first diode is connected to the power supply management circuit, and extends to the exterior of the control chip, forming the second pin.

3. The electronic detonator control chip according to claim 1, characterized in that the firing control circuit includes a second NMOS transistor; the source and the substrate of the second NMOS transistor are grounded, its drain is connected to the fifth pin, and its grid is connected to the logic control circuit.

4. The electronic detonator control chip according to claim 1, characterized in that the charging control circuit includes a third resistor, a fourth resistor, a second diode, a first PMOS transistor, and a third NMOS transistor, wherein the source and the substrate of the third NMOS transistor are grounded, its grid is connected to the logic control circuit, and its drain is connected to the grid of the first PMOS transistor; and the source and the substrate of the first PMOS transistor are connected to the rectifier bridge circuit, its drain connects to the third pin via the third resistor and the second diode in series, with the cathode of the second diode towards the third pin; and the fourth resistor crosses over the substrate of the first PMOS transistor and the drain of the third NMOS transistor.

5. The electronic detonator control chip according to claim 1, characterized in that the charging control circuit includes a fifth resistor, a sixth resistor, a third diode, a second PMOS transistor, and a fourth NMOS transistor, wherein the source and the substrate of the fourth NMOS transistor are grounded, its grid is connected to the logic control circuit, and its drain is connected to the grid of the second PMOS transistor;

the source and the substrate of the second PMOS transistor are connected to the rectifier bridge circuit via the fifth resistor; its drain is connected to the third pin via the third diode, with the cathode of the third diode towards the third pin; and the sixth resistor crosses over the substrate of the second PMOS transistor and the drain of the fourth NMOS transistor.

6. The electronic detonator control chip according to claim 1, characterized in that the rectifier bridge circuit includes a third PMOS transistor, a fourth PMOS transistor, a fifth NMOS transistor, and a sixth NMOS transistor, wherein the drain and the substrate of the third PMOS transistor and the drain and the substrate of the fourth PMOS transistor connect together, all connected to the charging circuit and the charging control circuit; the source and the substrate of the fifth NMOS transistor connect with the source and the substrate of the sixth NMOS transistor, and they are all grounded; and the source of the third PMOS transistor, the grid of the fourth PMOS transistor, the drain of the fifth NMOS transistor and the grid of the sixth NMOS transistor connect together, and extend to the exterior of the chip, forming one of the two first pins; and the source of the fourth PMOS transistor, the grid of the third PMOS transistor, the drain of the sixth NMOS transistor and the grid of the fifth NMOS transistor connect together, and extend to the exterior of the chip, forming the other one of the first pins.

7. The electronic detonator control chip according to claim 1, characterized in that the charging control circuit has another end, which is connected to the fourth pin within the chip, that is, it is connected to the power supply management circuit, and the charging control circuit is powered by the power supply management circuit.

8. The electronic detonator control chip according to claim 7, characterized in that the charging control circuit includes a fifth PMOS transistor, a sixth PMOS transistor, a seventh PMOS transistor, a seventh NMOS transistor, an eighth NMOS transistor, a ninth NMOS transistor, a seventh resistor, and a sixth diode;

the source and the substrate of the fifth PMOS transistor are connected to the power supply management circuit; the grid of the fifth PMOS transistor, the grid of the seventh NMOS transistor, and the grid of the eighth NMOS transistor are all connected to the logic control circuit; the drain of the fifth PMOS transistor, the drain of the seventh NMOS transistor, and the grid of the ninth NMOS transistor connect together;

the source and the substrate of the sixth PMOS transistor, and the source and the substrate of the seventh PMOS transistor connect together, with all connected to the rectifier bridge circuit; the grid of the sixth PMOS transistor, the drain of the seventh PMOS transistor, and the drain of the ninth NMOS transistor are all connected to one end of the seventh resistor; the other end of the seventh resistor is connected to the anode of the sixth diode, and the cathode of the sixth diode is connected to the third pin within the chip; the drain of the sixth PMOS transistor, the grid of the seventh PMOS transistor, and the drain of the eighth NMOS transistor connect together; and the source and the substrate of the seventh NMOS transistor, the source and the substrate of the eighth NMOS transistor, and the source and the substrate of the ninth NMOS transistor are grounded together.

9. The electronic detonator control chip according to claim 7, characterized in that the charging control circuit includes a fifth PMOS transistor, a sixth PMOS transistor, a seventh PMOS transistor, a seventh NMOS transistor, an eighth NMOS transistor, a ninth NMOS transistor, a seventh resistor, and a sixth diode;

the source and the substrate of the fifth PMOS transistor are connected to the power supply management circuit; the grid of the fifth PMOS transistor, the grid of the seventh NMOS transistor, and the grid of the eighth NMOS transistor are jointly connected to the logic control circuit; the drain of the fifth PMOS transistor, the drain of the seventh NMOS transistor, and the grid of the ninth NMOS transistor connect together;

the source and the substrate of the sixth PMOS transistor, the substrate of the seventh PMOS transistor, and one end of the seventh resistor are jointly connected to the rectifier bridge circuit; the other end of the seventh resistor is connected to the source of the seventh PMOS transistor; the grid of the sixth PMOS transistor, the drain of the seventh PMOS transistor, and the drain of the ninth NMOS transistor are jointly connected to the anode of the sixth diode; the cathode of the sixth diode is connected to the third pin within the chip; the drain of the sixth PMOS transistor, the drain of the eighth NMOS transistor, and the grid of the seventh PMOS transistor connect together; and the source and the substrate of the seventh NMOS transistor, the source and the substrate of the eighth NMOS transistor, and the source and the substrate of the ninth NMOS transistor are jointly grounded.

10. The electronic detonator control chip according to claim 7, characterized in that the charging control circuit includes a fifth PMOS transistor, a sixth PMOS transistor, a seventh PMOS transistor, a seventh NMOS transistor, an eighth NMOS transistor, a ninth NMOS transistor, a seventh resistor, and a sixth diode;

the source and the substrate of the fifth PMOS transistor are connected to the power supply management circuit; the grid of the fifth PMOS transistor, the grid of the seventh NMOS transistor, and the grid of the eighth NMOS transistor are jointly connected to the logic control circuit; the drain of the fifth PMOS transistor, the drain of the seventh NMOS transistor, and the grid of the ninth NMOS transistor connect together;

the source and the substrate of the sixth PMOS transistor, and the source and the substrate of the seventh PMOS transistor are jointly connected to one end of the seventh resistor; the other end of the seventh resistor is connected to the rectifier bridge circuit; the grid of the sixth PMOS transistor, the drain of the seventh PMOS transistor, and the drain of the ninth NMOS transistor are jointly connected to the anode of the sixth diode; the cathode of the sixth diode is connected to the third pin within the chip; the drain of the sixth PMOS transistor, the drain of the eighth NMOS transistor, and the grid of the seventh PMOS transistor connect together; and the source and the substrate of the seventh NMOS transistor, the source and the substrate of the eighth NMOS transistor, and the source and the substrate of the ninth NMOS transistor are grounded together.

11. The electronic detonator control chip according to claim 7, characterized in that the charging control circuit includes a fifth PMOS transistor, a sixth PMOS transistor, a seventh PMOS transistor, a seventh NMOS transistor, an eighth NMOS transistor, a ninth NMOS transistor, a seventh resistor, an eighth resistor, a ninth resistor, and a sixth diode;

the source and the substrate of the fifth PMOS transistor are connected to the power supply management circuit; the grid of the fifth PMOS transistor, the grid of the seventh NMOS transistor, and the grid of the eighth NMOS transistor are jointly connected to the logic control circuit; the drain of the fifth PMOS transistor, the drain of the seventh NMOS transistor, and the grid of the ninth NMOS transistor connect together;

the drain of the seventh PMOS transistor and the drain of the ninth NMOS transistor are both connected to one end of the seventh resistor; the other end of the seventh resistor is connected to the anode of the sixth diode;

the source and the substrate of the sixth PMOS transistor, and the source and the substrate of the seventh PMOS transistor are jointly connected to the rectifier bridge circuit; the drain of the sixth PMOS transistor is connected to one end of the eighth resistor; the other end of the eighth resistor is connected to the grid of the seventh PMOS transistor and also connected to one end of the ninth resistor; the other end of the ninth resistor is connected to the drain of the eighth NMOS transistor; the grid of the sixth PMOS transistor and the cathode of the sixth diode are connected to the third pin within the chip;

the source and the substrate of the seventh NMOS transistor, the source and the substrate of the eighth NMOS transistor, and the source and the substrate of the ninth NMOS transistor are grounded together.

12. The electronic detonator control chip according to claim 7, characterized in that the charging control circuit includes a fifth PMOS transistor, a sixth PMOS transistor, a seventh PMOS transistor, a seventh NMOS transistor, an eighth NMOS transistor, a ninth NMOS transistor, a seventh resistor, an eighth resistor, a ninth resistor, and a sixth diode;

the source and the substrate of the fifth PMOS transistor are connected to the power supply management circuit; the grid of the fifth PMOS transistor, the grid of the seventh NMOS transistor, and the grid of the eighth NMOS transistor are jointly connected to the logic control circuit; the drain of the fifth PMOS transistor, the drain of the seventh NMOS transistor, and the grid of the ninth NMOS transistor connect together;

the source and the substrate of the sixth PMOS transistor, and the source and the substrate of the seventh PMOS transistor are connected to one end of the seventh resistor; the other end of the seventh resistor is connected to the rectifier bridge circuit; the drain of the sixth PMOS transistor is connected to one end of the eighth resistor; the other end of the eighth resistor is connected to the grid of the seventh PMOS transistor and also connected to one end of the ninth resistor; the other end of the ninth resistor is connected to the drain of the eighth NMOS transistor; the grid of the sixth PMOS transistor and the cathode of the sixth diode are connected to the third pin;

the drain of the seventh PMOS transistor, the drain of the ninth NMOS transistor, and the anode of the sixth diode connect together; and the source and the substrate of the seventh NMOS transistor, the source and the substrate of the eighth NMOS transistor, and the source and the substrate of the ninth NMOS transistor are jointly grounded.

13. The electronic detonator control chip according to claim 7, characterized in that the charging control circuit includes a fifth PMOS transistor, a sixth PMOS transistor, a seventh PMOS transistor, a seventh NMOS transistor, an eighth NMOS transistor, a ninth NMOS transistor, a seventh resistor, an eighth resistor, a ninth resistor, and a sixth diode;

the source and the substrate of the fifth PMOS transistor are connected to the power supply management circuit; the grid of the fifth PMOS transistor, the grid of the seventh NMOS transistor, and the grid of the eighth NMOS transistor are jointly connected to the logic control circuit; the drain of the fifth PMOS transistor, the drain of the seventh NMOS transistor, and the grid of the ninth NMOS transistor connect together;

the source and the substrate of the sixth PMOS transistor, the substrate of the seventh PMOS transistor, and one end of the seventh resistor are jointly connected to the rectifier bridge circuit; the other end of the seventh resistor is connected to the source of the seventh PMOS transistor; the grid of the sixth PMOS transistor and the cathode of the sixth diode are jointly connected to the third pin; the drain of the sixth PMOS transistor is connected to one end of the eighth resistor; the other end of the eighth resistor is connected to the grid of the seventh PMOS transistor and also connected to one end of the ninth resistor; the other end of the ninth resistor is connected to the drain of the eighth NMOS transistor;

the drain of the seventh PMOS transistor, the drain of the ninth NMOS transistor, and the anode of the sixth diode connect together; and the source and the substrate of the seventh NMOS transistor, the source and the substrate of the eighth NMOS transistor, and the source and the substrate of the ninth NMOS transistor are jointly grounded.

14. The electronic detonator control chip according to claim 1, characterized in that the chip further includes a firing drive circuit; one end of the firing drive circuit is connected to the third pin, one end is grounded; and the firing drive circuit is connected in series between the logic control circuit and the firing control circuit via the other two ends of the firing drive circuit.

15. The electronic detonator control chip according to claim 14, characterized in that the firing drive circuit includes a ninth PMOS transistor, a twelfth resistor, an eleventh NMOS transistor, and a twelfth NMOS transistor, the source and the substrate of the ninth PMOS transistor and one end of the twelfth resistor connect together, and are connected to the third pin together; the other end of the twelfth resistor, the grid of the ninth PMOS transistor, the drain of the eleventh NMOS transistor, and the grid of the twelfth NMOS transistor connect together; the drain of the ninth PMOS transistor and the drain of the twelfth NMOS transistor connect together, with both connected to the grid of the second NMOS transistor; the source and the substrate of the eleventh NMOS transistor, and the source and the substrate of the twelfth NMOS transistor are grounded; the grid of the eleventh NMOS transistor is connected to the logic control circuit.

16. The electronic detonator control chip according to claim 14, characterized in that the firing drive circuit further includes an eighth PMOS transistor, a tenth NMOS transistor, a tenth resistor, and an eleventh resistor, the source and the substrate of the eighth PMOS transistor and one end of the tenth resistor connect together, and are jointly connected to the third pin; the grid of the eighth PMOS transistor, the other end of the tenth resistor, and the drain of the tenth NMOS transistor connect together; the drain of the eighth PMOS transistor and one end of the eleventh resistor connect together, and are jointly connected to the grid of the second NMOS transistor; the other end of the eleventh resistor is grounded; the source and the substrate of the tenth NMOS transistor are grounded with its grid connected to the logic control circuit.

17. The electronic detonator control chip according to claim 16, characterized in that the resistance of any of the tenth resistor, the eleventh resistor and the twelfth resistor is not less than 100 KΩ.

18. The electronic detonator control chip according to claim 1, characterized in that the chip further includes a firing drive circuit; one end of the firing drive circuit is connected to the third pin, one end is connected to the fourth pin, and one end is grounded; the firing drive circuit is connected in series between the logic control circuit and the firing control circuit via the other two ends of the firing drive circuit.

19. The electronic detonator control chip according to claim 18, characterized in that the firing drive circuit includes a first inverter, a tenth PMOS transistor, an eleventh PMOS transistor, a thirteenth NMOS transistor, and a fourteenth NMOS transistor, the source and the substrate of the tenth PMOS transistor, and the source and the substrate of the eleventh PMOS transistor connect together, and are jointly connected to the third pin; the drain of the tenth PMOS transistor, the grid of the eleventh PMOS transistor, and the drain of the thirteenth NMOS transistor connect together; the grid of the tenth PMOS transistor, the drain of the eleventh PMOS transistor, and the drain of the fourteenth NMOS transistor connect together, and are jointly connected to the grid of the second NMOS transistor;

the source and the substrate of the thirteenth NMOS transistor, and the source and the substrate of the fourteenth NMOS transistor are grounded; the grid of the thirteenth NMOS transistor and the input terminal of the first inverter connect together, and are jointly connected to the logic control circuit; the grid of the fourteenth NMOS transistor is connected to the output terminal of the first inverter; and the power supply input terminal of the first inverter is connected to the fourth pin, powered by the power supply management circuit; the other end of the first inverter is grounded.

20. The electronic detonator control chip according to claim 19, characterized in that the firing drive circuit further includes a fifteenth NMOS transistor, the drain of the fifteenth NMOS transistor, and the power supply input terminal of the first inverter connect together, and are jointly connected to the fourth pin, powered by the power supply management circuit;

the source of the fifteenth NMOS transistor, the grid of the tenth PMOS transistor, the drain of the eleventh PMOS transistor, and the drain of the fourteenth NMOS transistor connect together, and are jointly connected to the grid of the second NMOS transistor;

the grid of the fifteenth NMOS transistor, the grid of the thirteenth NMOS transistor, and the input terminal of the first inverter connect together, and are jointly connected to the logic control circuit; and the substrate of the fifteenth NMOS transistor is grounded.

21. The electronic detonator control chip according to claim 1, characterized in that the communication interface circuit includes a data modulation module and a data demodulation module, and the data demodulation module is composed of two data demodulation circuits, the two data demodulation circuits are connected to the first pin respectively, the two data demodulation circuits are connected to the logic control circuit respectively, the two data demodulation circuits are connected to the fourth pin together within the chip, and the two data demodulation circuits are also grounded; and one end of the data modulation module is connected to the logic control circuit, one end is grounded, and the other two ends are connected to the first pin respectively.

22. The electronic detonator control chip according to claim 21, characterized in that the data modulation module includes a thirteenth resistor, a fourteenth resistor, a fifteenth resistor, a sixteenth NMOS transistor, and a seventeenth NMOS transistor, the drain and the substrate of the sixteenth NMOS transistor, the drain and the substrate of the seventeenth NMOS transistor, and one end of the thirteenth resistor are grounded; the grid of the sixteenth NMOS transistor and the grid of the seventeenth NMOS transistor are connected to the other end of the thirteenth resistor, and are jointly connected to the logic control circuit; the source of the sixteenth NMOS transistor is connected to one of the two first pins via the fourteenth resistor, the source of the seventeenth NMOS transistor is connected to the other one of the first pins via the fifteenth resistor.

23. The electronic detonator control chip according to claim 21, characterized in that the data demodulation circuit includes a second inverter and an eighteenth NMOS transistor;

one end of the second inverter is connected to the fourth pin, one end is grounded, and the other two ends work as an input terminal and an output terminal respectively; and the source and the substrate of the eighteenth NMOS transistor are grounded; its drain and the input terminal of the second inverter connect together, and are jointly connected to one of the set of the first pin; the grid of the eighteenth NMOS transistor and the output terminal of the second inverter connect together, and are jointly connected to the logic control circuit.

24. The electronic detonator control chip according to claim 21, characterized in that the data demodulation circuit includes a second inverter and a sixteenth resistor; one end of the second inverter is connected to the fourth pin, one end is grounded; the input terminal of the second inverter is connected to one of the set of the first pin, and is grounded via the sixteenth resistor; and the output terminal of the second inverter is connected to the logic control circuit.

25. The electronic detonator control chip according to claim 24, characterized in that the second inverter is a Schmitt inverter.

26. The electronic detonator control chip according to claim 1, characterized in that the logic control circuit includes a programmable delay module, an input/output interface, a serial communication interface, a prescaler, and a CPU, one end of the CPU is connected to the fourth pin, one end is grounded; and one end is connected to the programmable delay module, the prescaler and the clock circuit; the other end of the CPU is connected to the programmable delay module, the input/output interface, the serial communication interface, and the prescaler via the internal bus;

one end of the programmable delay module is connected to the firing control circuit, one end is connected to the fourth pin, one end is grounded, one end is connected to the internal bus; and the other end is connected to the CPU, the prescaler and the clock circuit;

one end of the input/output interface is connected to the charging control circuit, one end is connected to the safe discharging circuit, one end is connected to the fourth pin, one end is grounded, and the other end is connected to the internal bus;

one end of the serial communication interface is connected to the communication interface circuit, one end is connected to the fourth pin, one end is grounded, one end is connected to the prescaler, and the other end is connected to the internal bus; and one end of the prescaler is connected to the fourth pin, one end is grounded, one end is connected to the serial communication interface, one end is connected to the internal bus; and the other end is connected to the CPU, the programmable delay module and the clock circuit.

27. The electronic detonator control chip according to claim 26, characterized in that the programmable delay module is a presettable down-counter.

28. A control process of the electronic detonator control chip according to claim 26, characterized in that the control process is carried out in accordance with the following steps:

step 1, initializing the programmable delay module: the CPU sending a control signal to the programmable delay module, causing it to output a signal to cut off the firing control circuit, into a fire-forbidden state;

step 2, the CPU reading the identity code of the electronic detonator stored in the non-volatile memory;

step 3, initializing the prescaler: the CPU writing the default number of clocks of the clock circuit into the prescaler to control the communication baud rate and the sampling phase;

step 4, the CPU waiting to receive instructions from an apparatus outside the electronic detonator: upon receiving a delay-time-writing instruction, performing step 5; upon receiving a firing instruction, performing step 6;

step 5, performing a delay-time-writing process; then going back to step 4; and step 6, performing a firing process, and then ending the control process.

29. The control process according to claim 28, characterized in that the delay-time-writing process is carried out in accordance with the following steps, step one, the CPU of a detonator judging whether or not to set a delay time for the detonator according to the identity code included in the delay-time-writing instruction: if the judgment being positive, performing step two; and if the judgment being negative, ending the delay-time-writing process;

step two, the CPU writing the delay-time data included in the delay-time-writing instruction into the programmable delay module; and step three, the electronic detonator sending a delay-time-writing-completed signal to the outside apparatus, and then ending the delay-time-writing process.

30. The control process according to claim 28, characterized in that the firing process is carried out in accordance with the following steps, step A, the CPU sending the control signal to the programmable delay module to start it;

step B, the CPU waiting for the end of the delay time, if the delay time reaching the end, perform step C; if not, continue waiting; and step C, the programmable delay module outputting a signal to the firing control circuit to turn on the firing control circuit, rendering it into an ignition state; then ending the firing process.

31. An electronic detonator, characterized by comprising a control chip comprising a communication interface circuit, a rectifier bridge circuit, a charging circuit, a charging control circuit, a power supply management circuit, a firing control circuit, a logic control circuit, a non-volatile memory, a reset circuit, a safe discharging circuit, and a clock circuit, wherein one end of the rectifier bridge circuit is connected to the communication interface circuit, forming a set of first pin extending to the exterior of the chip; one end of the rectifier bridge circuit leads to the charging circuit and the charging control circuit, supplying power to the charging circuit and the charging control circuit; the other end of the rectifier bridge circuit is grounded;

one end of the charging circuit is connected to the rectifier bridge circuit; the other end is connected to the power supply management circuit and also extends to the exterior of the chip, forming a set of second pin;

one end of the charging control circuit is connected to the rectifier bridge circuit, one end is grounded, and one end is connected to the logic control circuit; another end of the charging control circuit is connected to the safe discharging circuit and also extends to the exterior of the control chip, forming a set of third pin;

one end of the safe discharging circuit is connected to the logic control circuit, one end is grounded, and the other end is connected to the third pin within the control chip;

one end of the power supply management circuit is connected to the second pin within the control chip, and one end is grounded; the other end of the power supply management circuit extends to the exterior of the chip, forming a set of fourth pin as the power supply output terminal of the control chip;

one end of the communication interface circuit is grounded, one end is connected to the first pin within the control chip, one end leads to the logic control circuit, and the other end is connected to the fourth pin within the control chip;

one end of the reset circuit is grounded, one end is connected to the fourth pin within the control chip, and the other end is connected to the logic control circuit;

one end of the firing control circuit is grounded; one end extends to the exterior of the control chip, forming a set of fifth pin; and the other end leads to the logic control circuit;

one end of the clock circuit is connected to the fourth pin within the chip, and the other end leads to the logic control circuit;

one end of the logic control circuit is connected to the clock circuit, one end is connected to the fourth pin within the control chip, one end is grounded, one end is connected to the non-volatile memory, one end is connected to the communication interface circuit, one end is connected to the reset circuit, one end is connected to the safe discharging circuit, one end is connected to the charging control circuit, and the other end is connected to the firing control circuit; and one end of the non-volatile memory is connected to the fourth pin within the control chip, one end is connected to the logic control circuit, and the other end is grounded;

wherein the safe discharging circuit includes a second resistor and a first NMOS transistor; the source and the substrate of the first NMOS transistor are grounded, its drain is connected to the third pin via the second resistor, and its grid is connected to the logic control circuit.

* * * * *